US010535213B2

(12) United States Patent
Ino

(10) Patent No.: US 10,535,213 B2
(45) Date of Patent: Jan. 14, 2020

(54) PAPER CURRENCY-PROCESSING DEVICE

(71) Applicant: GLORY LTD., Himeji-shi, Hyogo (JP)

(72) Inventor: Kenichi Ino, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 677 days.

(21) Appl. No.: 14/776,919

(22) PCT Filed: Mar. 11, 2014

(86) PCT No.: PCT/JP2014/001372
§ 371 (c)(1),
(2) Date: Sep. 15, 2015

(87) PCT Pub. No.: WO2014/148000
PCT Pub. Date: Sep. 25, 2014

(65) Prior Publication Data

US 2016/0035172 A1 Feb. 4, 2016

(30) Foreign Application Priority Data

Mar. 18, 2013 (CN) ..... 2013 2 0121219 U

(51) Int. Cl.
*G07D 11/24* (2019.01)

(52) U.S. Cl.
CPC ..... *G07D 11/24* (2019.01)

(58) Field of Classification Search
CPC ..... G07D 11/0054; G07D 11/0084
(Continued)

(56) References Cited

U.S. PATENT DOCUMENTS 8,746,135 B2 * 6/2014 Sakoguchi ..... G07D 11/0084 100/26
9,908,653 B2 * 3/2018 Izumida ..... B65B 13/06
(Continued)

FOREIGN PATENT DOCUMENTS

EP 2 110 789 A1 10/2009
EP 2 273 458 A1 1/2011
(Continued)

OTHER PUBLICATIONS

European Office Action (Application No. 14 770 634.5) (6 pages—dated Mar. 1, 2017).

(Continued)

*Primary Examiner* — Chelsea E Stinson
(74) *Attorney, Agent, or Firm* — Renner Kenner Greive Bobak Taylor and Weber; Tim Hodgkiss; Edward Greive

(57) ABSTRACT

A banknote handling apparatus includes an inlet, a first transport unit and a second transport unit which are configured to transport banknotes taken in through the inlet, a recognition unit configured to recognize each of the banknotes, a bundling stacker configured to stack any banknote recognized, by the recognition unit, as a banknote to be bundled, a non-bundling stacker configured to stack any banknote recognized, by the recognition unit, as a banknote not to be bundled, a bundling unit configured to bundle the banknotes stacked in the bundling stacker, and a dispense port through which the banknotes bundled by the bundling unit are dispensed. The bundling stacker includes only two bundling stackers, and the non-bundling stacker includes only two non-bundling stackers.

12 Claims, 8 Drawing Sheets

(58) Field of Classification Search
USPC ..... 53/52, 54, 493, 504, 399
See application file for complete search history.

(56) References Cited

U.S. PATENT DOCUMENTS

| | | | | |
|---|---|---|---|---|
| 9,997,003 | B2 * | 6/2018 | Kobayashi | B65H 5/36 |
| 10,023,340 | B2 * | 7/2018 | Nagase | B65H 5/002 |
| 2003/0226455 | A1 | 12/2003 | Dopfer et al. | |
| 2005/0188861 | A1 | 9/2005 | Dopfer et al. | |
| 2011/0048891 | A1 | 3/2011 | Iwami | |
| 2011/0315760 | A1 * | 12/2011 | Ito | G07D 11/0021 235/375 |
| 2012/0240794 | A1 * | 9/2012 | Sakoguchi | B65B 27/08 100/7 |
| 2014/0182248 | A1 | 7/2014 | Sakoguchi et al. | |

FOREIGN PATENT DOCUMENTS

| | | | |
|---|---|---|---|
| EP | 2 306 412 | A1 | 4/2011 |
| EP | 2 502 830 | A1 | 9/2012 |
| JP | 5-286641 | A | 11/1993 |
| JP | 6-42612 | U | 6/1994 |
| JP | 2005-350074 | A | 12/2005 |
| JP | 2008-46804 | A | 2/2008 |
| JP | 2014-59830 | A | 4/2014 |

OTHER PUBLICATIONS

European Search Report (Application No. 14770634.5—PCT/JP2014/001372) (7 pages—dated Feb. 18, 2016).

* cited by examiner

FIG.5

| PATTERN | FIRST BUNDLING STACKER 4A | SECOND BUNDLING STACKER 4B | FIRST NON-BUNDLING STACKER 5A | SECOND NON-BUNDLING STACKER 5B |
|---|---|---|---|---|
| 1 | PREDETERMINED DENOMINATION | | | ALL DENOMINATIONS BUT THE PREDETERMINED DENOMINATION |
| | FIT BANKNOTE | | UNFIT BANKNOTE | |
| 2 | PREDETERMINED DENOMINATION | | | ALL DENOMINATIONS BUT THE PREDETERMINED DENOMINATION |
| 3 | PREDETERMINED DENOMINATION | | | |
| | FIT BANKNOTE | | UNFIT BANKNOTE | |
| 3-A | PREDETERMINED DENOMINATION | | | |
| | FIT BANKNOTE | | UNFIT BANKNOTE | |
| | FACE | BACK | | |
| 3-B | PREDETERMINED DENOMINATION | | | |
| | ATM(FIT BANKNOTE) | TLR(FIT BANKNOTE) | UNFIT(UNFIT BANKNOTE) | |
| 3-C | PREDETERMINED DENOMINATION | | | |
| | NEW VERSION/OLD VERSION | | | |
| | ATM(FIT BANKNOTE) | TLR(FIT BANKNOTE) | UNFIT(UNFIT BANKNOTE) | |
| 4 | PREDETERMINED DENOMINATION | | | ALL DENOMINATIONS BUT THE PREDETERMINED DENOMINATION |
| | FACE/BACK | | BACK/FACE | |
| 4-A | PREDETERMINED DENOMINATION | | | ALL DENOMINATIONS BUT THE PREDETERMINED DENOMINATION |
| | FACE/BACK | | BACK/FACE | |
| | PORTRAIT-UP | PORTRAIT-DOWN | | |
| 5 | PREDETERMINED DENOMINATION | | | |
| | FACE/BACK | | | BACK/FACE |
| | PORTRAIT-UP/PORTRAIT-DOWN | | PORTRAIT-DOWN/ PORTRAIT-UP | |
| 6 | PREDETERMINED DENOMINATION | | | ALL DENOMINATIONS BUT THE PREDETERMINED DENOMINATION |
| | FACE/BACK | | | |
| | PORTRAIT-UP/PORTRAIT-DOWN | | PORTRAIT-DOWN/ PORTRAIT-UP | |
| 7 | PREDETERMINED DENOMINATION | | | ALL DENOMINATIONS BUT THE PREDETERMINED DENOMINATION |
| | NEW VERSION/OLD VERSION | | OLD VERSION/NEW ERSION | |
| 7-A | PREDETERMINED DENOMINATION | | | ALL DENOMINATIONS BUT THE PREDETERMINED DENOMINATION |
| | NEW VERSION/OLD VERSION | | OLD VERSION/NEW ERSION | |
| | FIT BANKNOTE | UNFIT BANKNOTE | | |
| 7-B | PREDETERMINED DENOMINATION | | | ALL DENOMINATIONS BUT THE PREDETERMINED DENOMINATION |
| | NEW VERSION/OLD VERSION | | OLD VERSION/NEW ERSION | |
| | FACE | BACK | | |
| 8 | FIRST DENOMINATION | SECOND DENOMINATION | | |

PAPER CURRENCY-PROCESSING DEVICE

CROSS-REFERENCE TO RELATED APPLICATION

This application is based upon and claims the benefit of priority from the prior Chinese Patent Application No. 201320121219.8 filed on Mar. 18, 2013. The entire contents of this application are incorporated by reference herein.

BACKGROUND

The present disclosure relates to a banknote handling apparatus which takes loose banknotes therein, bundles the banknotes, and dispenses the bundled banknotes.

BACKGROUND ART

Japanese Utility Model Registration No. 2597752 discloses a banknote handling apparatus which takes loose banknotes therein, bundles the banknotes, and dispenses the bundled banknotes. The banknote handling apparatus is placed on the floor. A mount on which loose banknotes are mounted is provided in an upper portion of the banknote handling apparatus. The banknotes placed on the mount are taken into the apparatus by a feeding means. In the apparatus, the banknotes taken in are recognized, and some of the banknotes to be bundled are transported to a bundling unit, while the other banknotes not to be bundled are transported to a discharge unit in the upper portion of the apparatus. The banknotes to be bundled are bundled with a bundling band by the bundling unit, and then are dispensed to a collecting case. The collecting case is provided in a lower portion of the apparatus, and is configured to be drawable from the apparatus.

The banknote handling apparatus described in Patent Document 1 includes two stacking units which stack banknotes to be bundled, three stacking units which stack banknotes not to be bundled, and one stacking unit which stacks rejected banknotes. The banknotes taken into the banknote handling apparatus are sorted to be stacked in these stacking units.

SUMMARY

Some people may want to use the banknote handling apparatus on a desk depending on the situation in which the banknote handling apparatus is to be used. However, the banknote handling apparatus described above is designed to be placed on the floor, and is not suitable for desktop use. To use the banknote handling apparatus on the desk, the apparatus is preferably made compact. To make the banknote handling apparatus compact, the number of stacking units to be provided there is limited. However, the limited number of stacking units makes efficient handling of the banknotes difficult.

In view of the foregoing, it is therefore an object of the present disclosure to provide a banknote handling apparatus which allows for efficient handling of the banknotes while only a limited number of stacking units may be provided for the apparatus.

SOLUTION TO THE PROBLEM

The present disclosure is intended for a banknote handling apparatus. The banknote handling apparatus includes: an inlet through which banknotes are taken in one by one; a transport unit configured to transport each of the banknotes taken in through the inlet; a recognition unit configured to recognize each of the banknotes taken in through the inlet; a first stacking unit configured to stack any banknote recognized, by the recognition unit, as a banknote to be bundled; a second stacking unit configured to stack any banknote recognized, by the recognition unit, as a banknote not to be bundled; a bundling unit configured to bundle the banknotes stacked in the first stacking unit; and a dispense port through which the banknotes bundled by the bundling unit are dispensed. The first stacking unit includes only two first stacking units, and the second stacking unit includes only two second stacking units.

According to this configuration, only two first stacking units and only two second stacking units are provided. Thus, the number of the first and second stacking units is limited, which allows for making the banknote handling apparatus compact. The two first stacking units allow for performing a continuous bundling process, in which the banknotes to be bundled are first stacked in one of the first stacking units, and then start to be bundled when the number of banknotes stacked there reaches a predetermined number, while the banknotes to be bundled continue being stacked in the other first stacking unit, and then start to be bundled when the number of banknotes stacked in the other first stacking unit reaches the predetermined number. Alternatively, the two first stacking units allow for sorting the banknotes to be bundled into two groups such that they are stacked separately. Further, the two second stacking units allow for sorting the banknotes not to be bundled into two groups such that they are stacked separately. Thus, the banknotes are handled efficiently.

For example, one of the two first stacking units may stack the banknote recognized, by the recognition unit, as a banknote of a first predetermined denomination, and the other of the two first stacking units may stack the banknote recognized, by the recognition unit, as a banknote of a second predetermined denomination.

According to this configuration, the banknotes may be sorted into banknotes of two different denominations such that they are stacked and bundled separately.

Both of the two first stacking units may stack the banknote recognized, by the recognition unit, as a banknote of a predetermined denomination, and one of the two second stacking units stacks the banknote recognized, by the recognition unit, as a banknote of every denomination but the predetermined denomination.

According to this configuration, a determination is made, by their denomination, whether or not the given banknotes are to be bundled. The first stacking units stack the banknotes of the predetermined denomination. In the first stacking units, these banknotes may be bundled through the continuous bundling process, or may be further sorted into two groups to be stacked and bundled separately. At least one of the second stacking units stacks the banknotes of every denomination but the predetermined one.

The recognition unit may recognize the banknote according to fitness level as a first-level banknote or a second-level banknote. Both of the two first stacking units may stack the banknotes recognized, by the recognition unit, as the first-level banknotes of a predetermined denomination, and one of the two second stacking units may stack the banknote recognized, by the recognition unit, as the second-level banknote of the predetermined denomination.

According to this configuration, the two first stacking units stack the banknotes of the predetermined denomination and the first fitness level. Thus, these banknotes may be bundled through the continuous bundling process, or may be further sorted into two groups to be stacked and bundled separately. One of the two second stacking units stacks the banknotes of the predetermined denomination and the second fitness level. Thus, the other of the two second stacking units may stack the banknotes that have been sorted otherwise.

As a configuration in which the banknotes of the predetermined denomination and the first fitness level are further sorted into two groups to be stacked in the two first stacking units, one of the two first stacking units may stack the banknote recognized, by the recognition unit, as the first-level banknote of the predetermined denomination which has its face turned upward, and the other of the two first stacking units may stack the banknote recognized, by the recognition unit, as the first-level banknote of the predetermined denomination which has its back turned upward.

According to this configuration, the first-level banknotes of the predetermined denomination may be further sorted depending on whether they have their face or their back turned upward such that the sorted groups of banknotes are stacked and bundled separately.

The recognition unit may recognize the banknote according to fitness level as a first-level banknote, a second-level banknote, or a third-level banknote. One of the two first stacking units may stack the banknote recognized, by the recognition unit, as the first-level banknote of a predetermined denomination, the other of the two first stacking units may stack the banknote recognized, by the recognition unit, as the second-level banknote of the predetermined denomination, and one of the two second stacking units may stack the banknote recognized, by the recognition unit, as the third-level banknote of the predetermined denomination.

According to this configuration, the banknotes of the predetermined denomination may be sorted into three groups according to fitness level, and two of the three groups of banknotes may be stacked in the two first stacking units, respectively, and the other group of banknotes may be stacked in the second stacking unit.

Both of the two first stacking units may stack the banknote recognized, by the recognition unit, as a banknote of a predetermined denomination which has one of its face and its back turned upward. One of the two second stacking units may stack the banknote recognized, by the recognition unit, as a banknote of the predetermined denomination which has the other of its face and its back turned upward. The other of the two second stacking units may stack the banknote recognized, by the recognition unit, as a banknote of every denomination but the predetermined denomination.

According to this configuration, the first stacking units stack the banknotes of the predetermined denomination that have one of their face and their back turned upward. In the first stacking units, these banknotes may be bundled through the continuous bundling process, or may be further sorted into two groups such that those two groups of banknotes are stacked and bundled separately. The banknotes which are not stacked in the first stacking units are further sorted such that the sorted banknotes are stacked in the two second stacking units. In particular, one of the two second stacking units stacks the banknotes of the predetermined denomination that have the other of their face and their back turned upward, and the other second stacking unit stacks the banknotes of every denomination but the predetermined one.

As another configuration in which the banknotes of the predetermined denomination that have one of their face and their back turned upward are further sorted into two groups to be stacked in the two first stacking units, one of the two first stacking units stacks the banknote recognized, by the recognition unit, as a banknote of the predetermined denomination having one of its face and its back turned upward which has its print orientation facing a predetermined direction, and the other of the two first stacking units stacks the banknote recognized, by the recognition unit, as a banknote of the predetermined denomination having the one of its face and its back turned upward which has its print orientation facing opposite to the predetermined direction.

According to this configuration, the banknotes of the predetermined denomination that have one of their face and their back turned upward may be further sorted depending on whether their print orientation faces the predetermined direction or opposite to the predetermined direction such that the sorted groups of banknotes are stacked and bundled separately.

Both of the two first stacking units may stack the banknote recognized, by the recognition unit, as a banknote of a predetermined denomination having one of its face and its back turned upward which has its print orientation facing a predetermined direction, one of the two second stacking units may stack the banknote recognized, by the recognition unit, as a banknote of the predetermined denomination having the one of its face and its back turned upward which has its print orientation facing opposite to the predetermined direction, and the other of the two second stacking units may stack the banknote recognized, by the recognition unit, as a banknote of the predetermined denomination having the other of its face and its back turned upward or as a banknote of every denomination but the predetermined denomination.

According to this configuration, the two first stacking units stack the banknotes of the predetermined denomination having one of their face and their back turned upward which have their print orientation facing the predetermined direction. Thus, these banknotes may be bundled through the continuous bundling process, or may be further sorted into two groups such that the sorted groups of banknotes are stacked and bundled separately. The banknotes which are not stacked in the first stacking units are further sorted to be stacked in the two second stacking units. In particular, one of the second stacking units stacks the banknotes of the predetermined denomination having one of their face and their back turned upward which have their print orientation facing opposite to the predetermined direction, and the other second stacking unit stacks the banknotes of the predetermined denomination having the other of their face and their back turned upward, or the banknotes of every denomination but the predetermined denomination.

Both of the two first stacking units may stack the banknote recognized, by the recognition unit, as a banknote of a predetermined denomination and of one of new and old versions. One of the two second stacking units may stack the banknote recognized, by the recognition unit, as a banknote of the predetermined denomination and of the other of the new and old versions. The other of the two second stacking units may stack the banknote recognized, by the recognition unit, as a banknote of every denomination but the predetermined denomination.

According to this configuration, the two first stacking units stack the banknotes of the predetermined denomination and of one of the new and old versions. Thus, these banknotes may be bundled through the continuous bundling process, or may be further sorted into two groups such that the sorted groups of banknotes are stacked and bundled separately. The banknotes which are not stacked in the first stacking units are further sorted to be stacked in the two second stacking units. In particular, one of the second stacking units stacks the banknotes of the predetermined denomination and of the other of the new and old versions, and the other second stacking unit stacks the banknotes of every denomination but the predetermined denomination.

As another configuration in which the banknotes of the predetermined denomination and of one of the new and old versions are further sorted into two groups to be stacked in the two first stacking units, among the banknotes recognized, by the recognition unit, as banknotes of the predetermined denomination and of one of new and old versions, (i) one of the two first stacking units may stack the banknote recognized, by the recognition unit, as the first-level banknote, and (ii) the other of the two first stacking units may stack the banknote recognized, by the recognition unit, as the third-level banknote.

According to this configuration, the banknotes of the predetermined denomination and of one of the new and old versions may be further sorted according to fitness level such that the sorted groups of banknotes are stacked and bundled separately.

As another configuration in which the banknotes of the predetermined denomination and of one of the new and old versions are further sorted into two groups to be stacked in the two first stacking units, one of the two first stacking units may stack the banknote recognized, by the recognition unit, as a banknote of the predetermined denomination and of one of the new and old versions which has its face turned upward, and the other of the two first stacking units may stack the banknote recognized, by the recognition unit, as a banknote of the predetermined denomination and of one of the new and old versions which has its back turned upward.

According to this configuration, the banknotes of the predetermined denomination and of one of the new and old versions may be further sorted depending on whether they have their face or their back turned upward such that the sorted groups of banknotes are stacked and bundled separately.

Among the banknotes recognized, by the recognition unit, as banknotes of the predetermined denomination and of one of new and old versions, (i) one of the two first stacking units may stack the banknote recognized, by the recognition unit, as the first-level banknote, (ii) the other of the two first stacking units may stack the banknote recognized, by the recognition unit, as the second-level banknote, and (iii) one of the two second stacking units may stack the banknote recognized, by the recognition unit, as the third-level banknote.

According to this configuration, the banknotes of the predetermined denomination and of one of the new and old versions are sorted into three groups according to fitness level, and two of the three groups of banknotes may be stacked in the two first stacking units, respectively, and the other group of banknotes may be stacked in the second stacking unit.

The banknote handling apparatus may further include a display unit configured to display locations of the first and second stacking units, and information about the banknote stacked in the first and second stacking units.

According to this configuration, one can easily understand what kind of banknotes are stacked in which part of the banknote handling apparatus.

Each of the first and second stacking units may be provided with an outlet through which the banknote stacked therein is removed out of the apparatus. Each of the outlets of the first stacking units may be provided with an open/close unit which is openable and closable individually. Each of the outlets of the second stacking units may be provided with no open/close units, and may be kept opened.

According to this configuration, the banknotes stacked in the first and second stacking units are removable through the outlets. The open/close unit provided for the outlet of the first stacking unit allows for preventing unwanted popping of the banknotes from the outlet. Since no open/close units are provided for the outlet of the second stacking unit, the banknotes stacked in the second stacking unit are removable easily.

The banknote handling apparatus may further include a reject stacking unit configured to stack the banknote recognized, by the recognition unit, as a banknote to be rejected.

According to this configuration, the reject stacking unit is provided in addition to the two first stacking units and the two second stacking units. Thus, the rejected banknotes are easily sorted and stacked separately.

Embodiments of the banknote handling apparatus described above provide a banknote handling apparatus which handles banknotes efficiently while the number of the stacking units provided is limited.

BRIEF DESCRIPTION OF THE DRAWINGS

FIG. 5 is a table showing various combinations of banknotes to be stacked in stackers.

DETAILED DESCRIPTION

Embodiments will be described in detail below with reference to the drawings.

(First Embodiment)

<General Configuration for Banknote Handling Apparatus>

Figure 1:
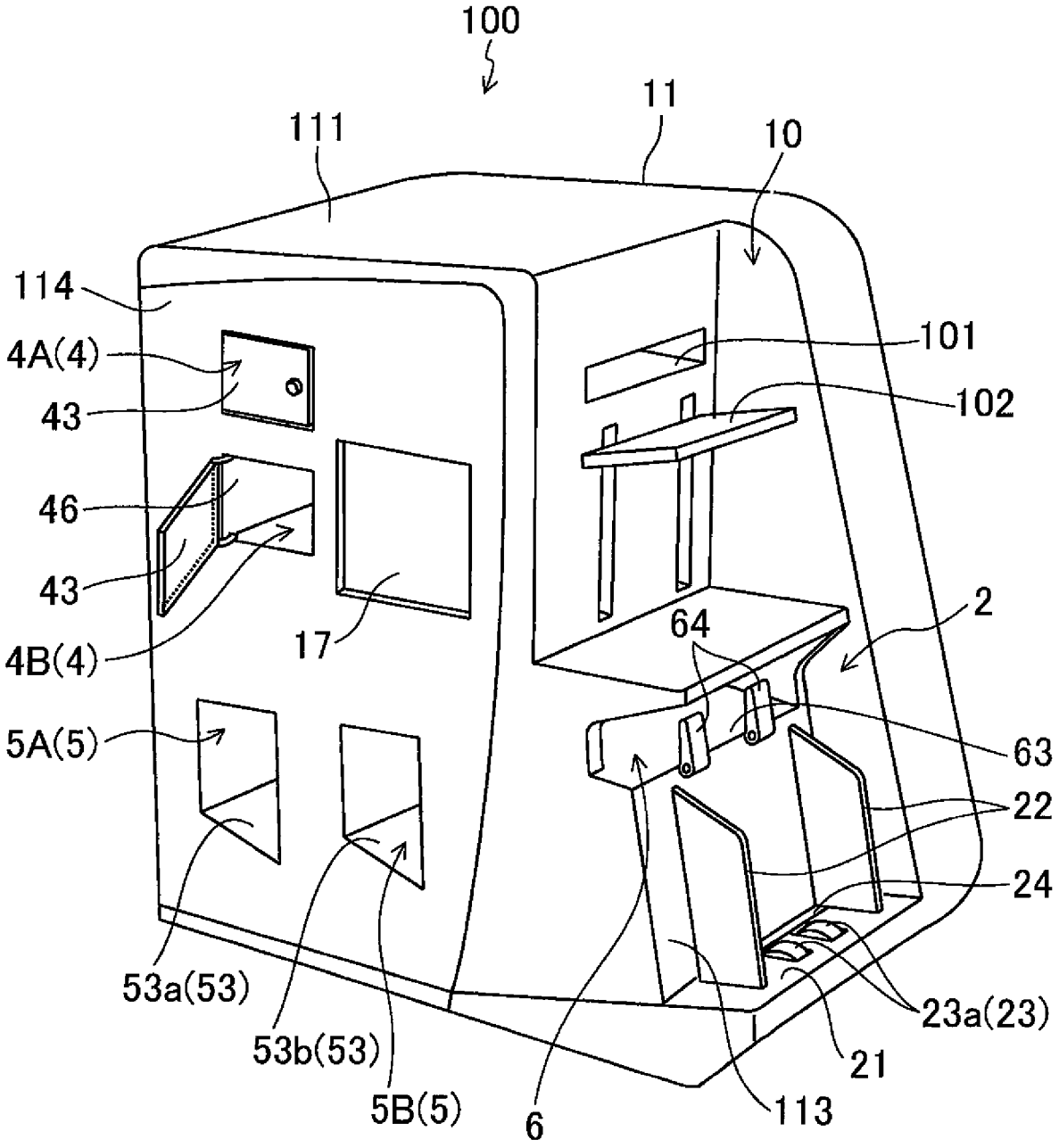
FIG. 1 is a view illustrating the appearance of a banknote handling apparatus according to a first embodiment.
Figure 2:
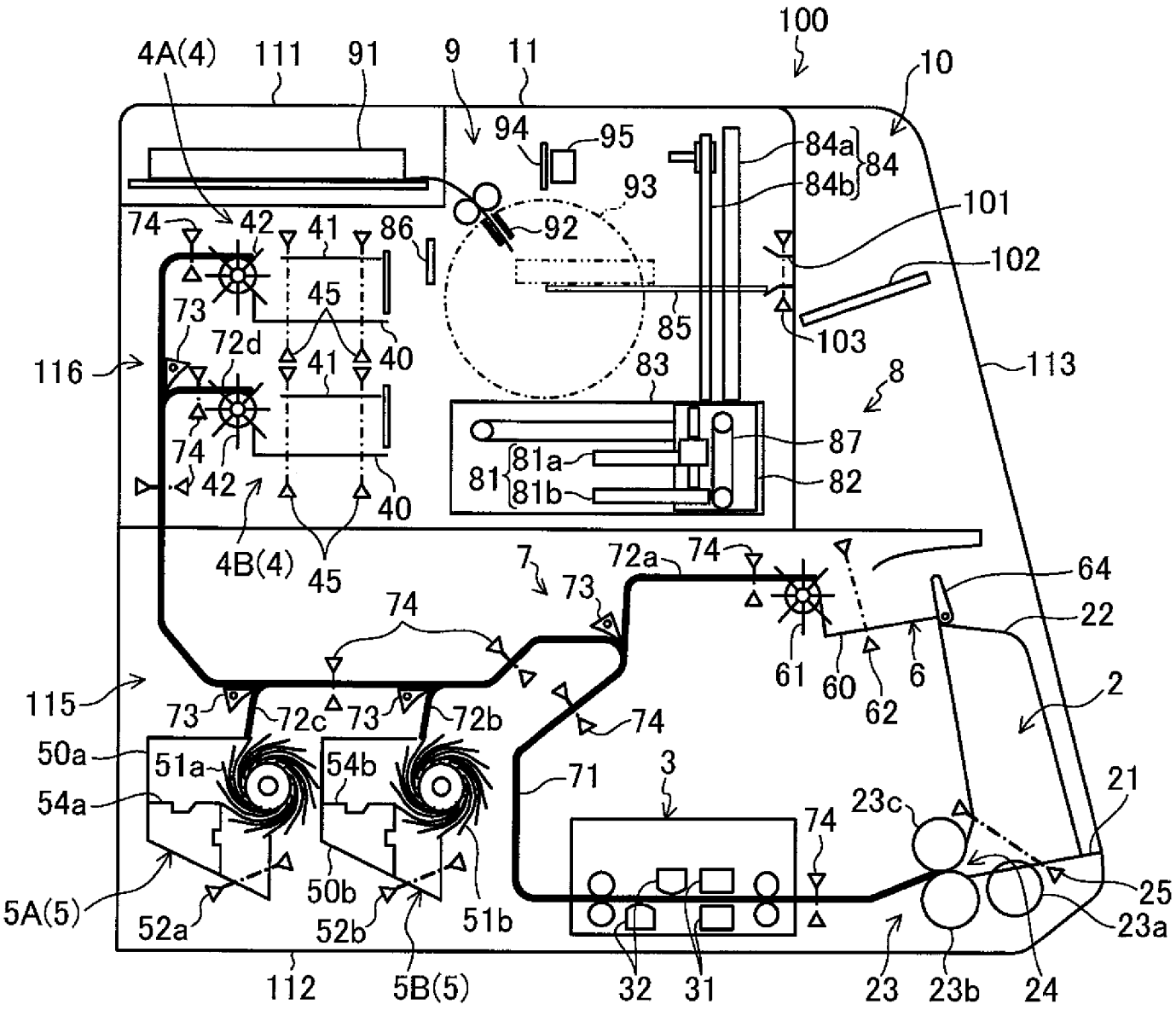
FIG. 2 illustrates a general configuration for the banknote handling apparatus.

FIG. 1 illustrates the appearance of a banknote handling apparatus 100, and FIG. 2 illustrates a general configuration for the banknote handling apparatus 100.

The banknote handling apparatus 100 is placed on a teller counter of a bank, for example, and is used by an operator. The banknote handling apparatus 100 takes loose banknotes therein, stacks the banknotes of a predetermined kind, bundles the banknotes in a predetermined bundling number, and dispenses the bundled banknotes.

The banknote handling apparatus 100 includes a hopper unit 2 which takes the banknotes placed thereon into the apparatus, a recognition unit 3 which recognizes the banknotes, bundling stackers 4 which stack the banknotes to be bundled, non-bundling stackers 5 which stack the banknotes not to be bundled, a reject stacker 6 which stacks rejected banknotes, a first transport unit 7 which transports the banknotes taken in through the hopper unit 2 to the recognition unit 3, the bundling stackers 4, the non-bundling stackers 5, and the reject stacker 6, a second transport unit 8 which transports the banknotes stacked in the bundling stackers 4 to the predetermined position, a bundling unit 9 which bundles the banknotes transported by the second transport unit 8, a dispense unit 10 through which the banknotes that have been bundled (hereinafter referred to as "bundled banknotes") are dispensed, and a box-shaped housing 11 which houses the recognition unit 3, the bundling stackers 4, the non-bundling stackers 5, the reject stacker 6, the first transport unit 7, the second transport unit 8, and the bundling unit 9.

The housing 11 has a top surface 111, a bottom surface 112, and four side surfaces. The housing 11 is a desktop type housing. That is to say, the bottom surface 112 of the housing 11 is not provided with casters or any other similar parts, and thus the housing 11 is configured to be placed on the desk.

The hopper unit 2 and the dispense unit 10 are provided through a first side surface 113, which is one of the four side surfaces of the housing 11. First outlets 46 of the bundling stackers 4 and second outlets 53 of the non-bundling stackers 5, which will be described in detail later, are provided through a second side surface 114, which is another one of the four side surfaces. The first and second side surfaces 113 and 114 are adjacent to each other.

The space inside the housing 11 is divided into a first handling section 115 configured to perform various kinds of handling processes for recognizing and sorting the banknotes and a second handling section 116 configured to perform various kinds of handling processes for bundling the banknotes to be bundled. The second handling section 116 is provided above the first handling section 115. The first handling section 115 includes the hopper unit 2, the recognition unit 3, the non-bundling stackers 5, and the reject stacker 6. The second handling section 116 includes the bundling stackers 4, the second transport unit 8, and the bundling unit 9. Most of the first transport unit 7 is included in the first handling section 115.

The bundling stackers 4 include two stackers, namely, a first bundling stacker 4A and a second bundling stacker 4B. Both of the first and second bundling stackers 4A and 4B stack the banknotes to be bundled. As will be described in detail later, the banknotes stacked as those to be bundled are determined as appropriate. The banknotes to be bundled are banknotes of a predetermined kind. The predetermined kind is identified by denomination or the orientation of the banknotes, or by determining whether the banknotes are fit or unfit, whether the banknotes are facing up or down, or whether the banknotes are new or not, for example. In this example, the banknotes to be bundled are fit banknotes of a predetermined denomination (e.g., 100 Chinese Yuan). In the following description, the banknotes which are recognized as normal by the recognition unit 3 will be hereinafter referred to as "normal banknotes," the banknotes which are not recognized as normal by the recognition unit 3 will be hereinafter referred to as "abnormal banknotes," and the banknotes which are transported in an abnormal state, e.g., skewed or multi-fed, will be hereinafter referred to as "abnormally transported banknotes." For example, one of the conditions for determining whether the banknotes are normal or not is whether the serial numbers of the banknotes are distinguishable or not. However, the normality of the banknotes may be checked based on a different condition, or an additional condition may be applied to determine whether the banknotes are normal or not. The banknotes which are determined as the normal banknotes but the destination of which (the bundling stacker, the non-bundling stacker, or other stackers) is not designated will be hereinafter referred to as "undesignated banknotes." The "undesignated banknotes," the "abnormal banknotes," and the "abnormally transported banknotes" will be hereinafter collectively referred to as "rejected banknotes." Among the normal banknotes, those which are not stained or torn significantly will be hereinafter referred to as "fit banknotes," and those which are stained or torn significantly will be hereinafter referred to as "unfit banknotes." The bundling stacker 4 is an exemplary first stacking unit.

The first and second bundling stackers 4A and 4B are arranged vertically, i.e., one on top of the other, in the second handling section 116. The first bundling stacker 4A is positioned over the second bundling stacker 4B. The first and second bundling stackers 4A and 4B have the same configuration. When it is not necessary to distinguish the two stackers from each other, they will be hereinafter referred to as "bundling stackers 4." A detailed configuration of the bundling stackers 4 will be described later.

The non-bundling stackers 5 include two stackers, namely, a first non-bundling stacker 5A and a second non-bundling stacker 5B. The first and second non-bundling stackers 5A and 5B are aligned substantially horizontally, i.e., side by side, in the first handling section 115. The second non-bundling stacker 5B is arranged closer to the hopper unit 2 than the first non-bundling stacker 5A is. When it is not necessary to distinguish the two stackers from each other, they will be hereinafter referred to as "non-bundling stackers 5." A detailed configuration of the non-bundling stackers 5 will be described later. The banknotes to be stacked in the non-bundling stackers 5 may be determined as appropriate. Here, the first non-bundling stacker 5A stacks unfit banknotes of the predetermined denomination. The second non-bundling stacker 5B stacks banknotes of all denominations but the predetermined denomination. The non-bundling stacker 5 is an exemplary second stacking unit.

The reject stacker 6 stacks the rejected banknotes. The reject stacker 6 is positioned closer to the hopper unit 2 than the first and second non-bundling stackers 5A and 5B are. The reject stacker 6 is positioned at a level slightly higher than the first and second non-bundling stackers 5A and 5B. A detailed configuration of the reject stacker 6 will be described later.

The hopper unit 2 is provided for a portion of the first side surface 113 corresponding to the first handling section 115, and the dispense unit 10 is provided for a portion of the first side surface 113 corresponding to the second handling section 116. Specifically, the first side surface 113 has two recesses in upper and lower portions thereof, and the dispense unit 10 is provided in the upper one of the two recesses, while the hopper unit 2 is provided in the lower one of the two recesses. A step is formed between the dispense unit 10 and the hopper unit 2.

The hopper unit 2 includes a mount 21 on which banknotes are placed, two guides 22, 22 which guide the banknotes placed on the mount 21, intake rollers 23, an inlet 24 through which the banknotes are taken in, and a banknote sensor 25 which senses the banknotes on the mount 21. In the present embodiment, the banknotes are placed on the hopper unit 2 such that the banknotes are taken in along their shorter edges.

As shown in FIG. 1, the inlet 24 is arranged at a corner where the mount 21 and the first side surface 113 intersect with each other. The mount 21 is tilted such that the closer to the inlet 24, the lower the level of the mount 21. Thus, the banknotes on the mount 21 go toward the inlet 24 by themselves. The banknotes placed on the mount 21 are taken into the housing 11 through the inlet 24.

The banknote sensor 25 is provided near the inlet 24. The banknote sensor 25 includes a transmitter which emits light and a receiver which receives the light, and senses the banknotes when the light emitted from the transmitter toward the receiver is blocked. A banknote sensor 45, stacking sensors 52 and 62, and tracking sensors 74 and 103 to be described later are also configured in the same manner. The banknote sensor 25 is arranged such that the light is blocked by the banknotes placed on the mount 21. That is to say, the banknote sensor 25 can sense that the banknotes are placed on the mount 21 when the light is blocked.

The guides 22, 22 are configured such that the interval between them is adjustable. Specifically, the interval between the guides 22, 22 is adjusted according to the banknotes placed on the mount 21.

The intake rollers 23 include kicker rollers 23*a*, feed rollers 23*b*, and gate rollers 23*c*. The kicker rollers 23*a* are partially exposed from the mount 21, and are in contact with the lowermost one of the banknotes placed on the mount 21. The kicker rollers 23*a* feed the lowermost banknote on the mount 21 to the inlet 24. Thus, the banknotes are taken in through the inlet 24 one by one. The banknotes taken in through the inlet 24 are distributed one by one by the feed rollers 23*b* and the gate rollers 23*c* into the housing 11. The banknotes thus taken in are passed to the first transport unit 7.

The dispense unit 10 includes a dispense port 101 through which the bundled banknotes are dispensed, a stage 102 on which the bundled banknotes dispensed through the dispense port 101 are placed, and a tracking sensor 103 which senses the bundled banknotes passing through the dispense port 101. The bundled banknotes are dispensed through the dispense port 101 along their shorter edges.

The stage 102 is tilted such that the more distant from the dispense port 101, the higher the level of the stage 102. The stage 102 is configured to be movable in the vertical direction, and is biased upward by a bias spring (not shown). The stage 102 is located immediately below the dispense port 101 when no bundled banknotes are placed thereon. When the bundled banknotes are placed on the stage 102, the stage 102 moves downward due to the weight of the bundled banknotes. The stage 102 moves downward at least until the uppermost one of the banknotes on the stage 102 is located below the dispense port 101. That is to say, no bundled banknotes are present at the same level as the dispense port 101. Thus, the bundled banknotes dispensed from the dispense port 101 are mounted one after another on the bundled banknotes that have already been placed on the stage 102. The tracking sensor 103 is configured in the same manner as the banknote sensor 25. The tracking sensor 103 is provided at the dispense port 101 to sense the banknotes passing through the dispense port 101.

The first transport unit 7 may be configured as a transport belt or any other suitable member. The first transport unit 7 includes a main transport path 71, four diverged paths 72, 72, . . . diverged from the main transport path 71, sorting mechanisms 73 provided at junctions between the main transport path 71 and the diverged paths, and a plurality of tracking sensors 74 which sense the passage of the banknotes. The first transport unit 7 transports the banknotes along their shorter edges. The first transport unit 7 is an exemplary transport unit.

The main transport path 71 extends from the intake rollers 23 to the first bundling stacker 4A. When they need to be distinguished from each other, the four diverged paths 72, 72, . . . will be hereinafter referred to as a first diverged path 72*a*, a second diverged path 72*b*, a third diverged path 72*c*, and a fourth diverged path 72*d*, respectively, in this order so that the most upstream diverged path 72 is regarded as the first diverged path 72*a*, the second most upstream one as the second, and so on. The first diverged path 72*a* extends to reach the reject stacker 6. The second diverged path 72*b* extends to reach the second non-bundling stacker 5B. The third diverged path 72*c* extends to reach the first non-bundling stacker 5A. The fourth diverged path 72*d* extends to reach the second bundling stacker 4B.

The sorting mechanisms 73 are driven by a solenoid (not shown). Each of the sorting mechanisms 73 sorts the banknotes transported through the main transport path 71 depending on whether they need to be guided to an associated one of the diverged paths 72 or not. A tracking sensor 74 is provided upstream of each of the sorting mechanisms 73. The tracking sensors 74 are configured in the same manner as the banknote sensor 25. That is, the tracking sensors 74 can sense the passage of the banknotes if the reception of light by the receiver of the tracking sensor 74 is temporarily interrupted and then resumed. In guiding the banknotes to the diverged path 72, each sorting mechanism 73 is turned ON as soon as the tracking sensor 74 immediately upstream thereof senses the passage of the banknotes.

The recognition unit 3 is provided on the main transport path 71 upstream of the first diverged path 72*a*. The recognition unit 3 is configured to recognize each of the banknotes being transported in terms of their denomination, authentication, and fitness level. Specifically, the recognition unit 3 includes a line sensor 31 and a magnetic sensor 32, and senses the feature of each banknote. The recognition unit 3 determines whether the feature of the banknote thus sensed corresponds with any of the features of the banknotes stored, thereby making a determination about their denomination, authentication, and fitness level.

The recognition unit 3 does not always include the line sensor and the magnetic sensor, but may include any other suitable sensor such as an infrared sensor and an ultraviolet sensor as long as they can sense the features of the banknotes. The line sensor 31 also has the function of optically reading the serial numbers printed on the banknotes. Note that a control unit 120 to be described later may have all of the functions of the recognition unit 3 but the sensing function.

The second transport unit 8 grips the banknotes stacked in the bundling stackers 4 and transports them to a predetermined position where they are bundled. The second transport unit 8 includes a transport part 82 which grips the banknotes, a horizontal displacement mechanism 83 which displaces the transport part 82 in the horizontal direction, a vertical displacement mechanism 84 which displaces the transport part 82 in the vertical direction, a stage 85 on which the transported banknotes are placed, and a pushing mechanism 86 which pushes the bundled banknotes on the stage 85 toward the dispense port 101. The second transport unit 8 is an exemplary transport unit.

The transport part 82 includes hands 81 including an upper hand 81*a* and a lower hand 81*b*, and a displacement mechanism 87 which displaces the upper hand 81*a* in the vertical direction. The displacement mechanism 87 supports the upper hand 81*a* so that the upper hand 81*a* is movable in the vertical direction, and displaces the upper hand 81*a* in the vertical direction using a drive motor and a drive belt. The lower hand 81*b* is fixed so as not to be movable. The transport part 82 can grip the banknotes between the upper and lower hands 81*a* and 81*b* by displacing the upper hand 81*a* vertically using the displacement mechanism 87.

The horizontal displacement mechanism 83 supports the transport part 82 so that the transport part 82 is movable in the horizontal direction toward or away from the bundling stacker 4. The horizontal displacement mechanism 83 displaces the transport part 82 in the horizontal direction using the drive motor and the drive belt.

The vertical displacement mechanism 84 includes a guide shaft 84*a* which supports the horizontal displacement mechanism 83 so that the horizontal displacement mechanism 83 is movable in the vertical direction, and a drive belt 84*b* which drives the horizontal displacement mechanism 83 along the guide shaft 84*a*. The vertical movement of the horizontal displacement mechanism 83 displaces the transport part 82 in the vertical direction, too.

The stage 85 is provided substantially horizontally, and is connected to the dispense port 101 at one end. In bundling the banknotes with the bundling unit 9, the banknotes are placed on the stage 85.

The pushing mechanism 86 is configured to push the bundled banknotes on the stage 85 toward the dispense port 101.

The bundling unit 9 bundles the banknotes on the stage 85 with a bundling band. Specifically, the bundling unit 9 includes a bundling band reel 91 housing the bundling band, a bundling band stopper 92 which holds a tip end of the bundling band drawn from the bundling band reel 91, a turning arm 93 which turns the bundling band stopper 92 around the banknotes to wrap the bundling band around the banknotes, and a cutter 94 which cuts the other end of the bundling band wrapped around the banknotes, and a heater 95 which thermally seals the other end of the bundling band thus cut.

On the second side surface 114 of the housing 11, a touch panel 17 is provided to serve as an operating unit through which information is entered into the banknote handling apparatus 100 and as a display unit which displays information about the banknote handling apparatus 100. Specifically, the touch panel 17 is provided above a second outlet 53*b* of the second non-bundling stacker 5B and beside a first outlet 46 of the second bundling stacker 4B. The touch panel 17 is a human interface for the operator who operates this banknote handling apparatus 100. The touch panel 17 is an exemplary display unit.

<Detailed Configuration for Bundling Stacker 4>

Figure 3:
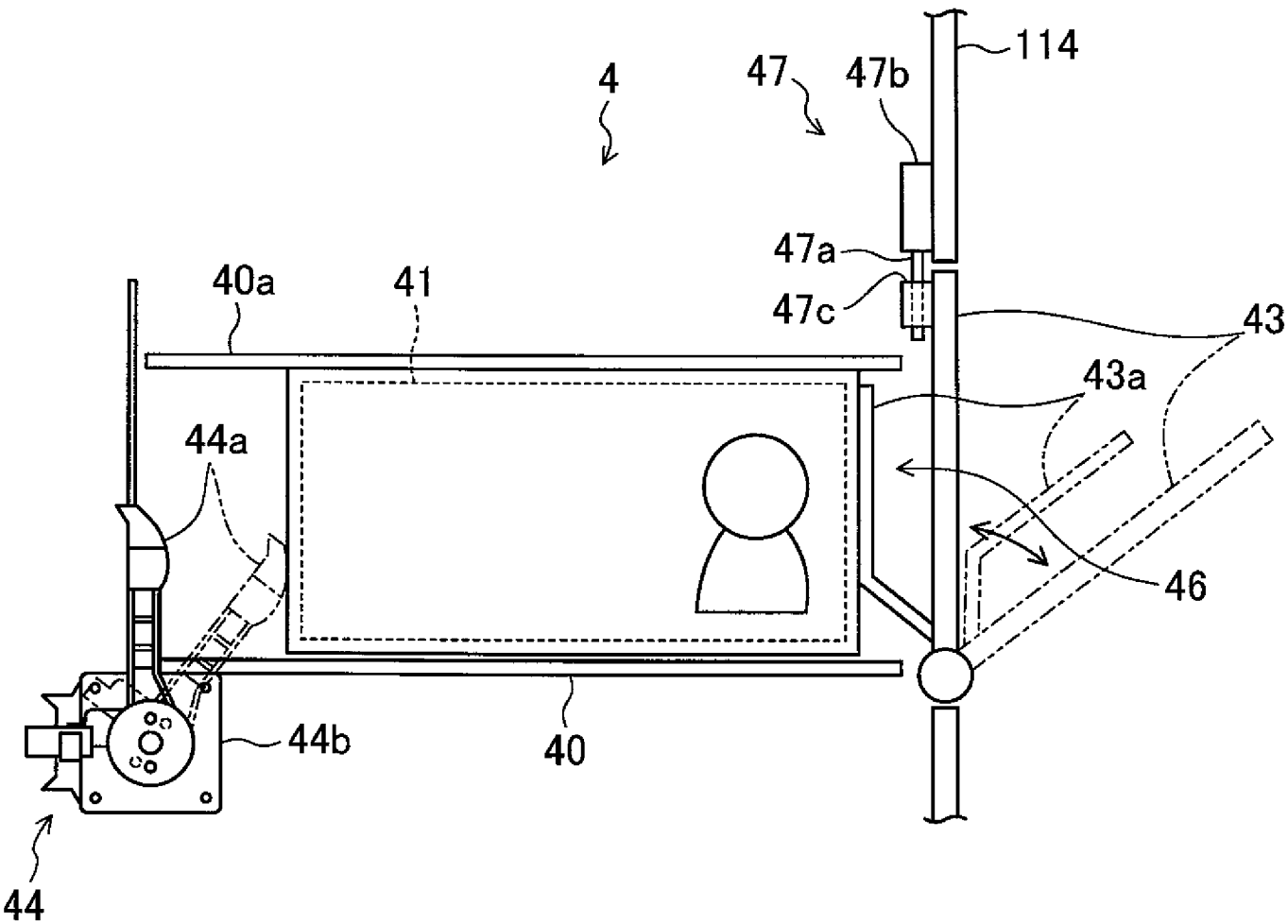
FIG. 3 is a plan view illustrating a bundling stacker with a portion thereof not illustrated.

FIG. 3 is a plan view of the bundling stacker 4 with a portion thereof not illustrated.

The bundling stackers 4 pile and stack the banknotes. Each of the bundling stackers 4 includes a container 40 in which the banknotes are stacked, a stage 41 arranged in the container 40 to carry the banknotes thereon, a stacking wheel 42 (shown in FIG. 2 only) which brings the transported banknotes into the container 40, a door 43 which opens/closes the first outlet 46 to be described later (shown in FIGS. 1 and 3), an aligner mechanism 44 (shown in FIG. 3 only) which aligns the edges of the stacked banknotes, and a banknote sensor 45 (shown in FIG. 2 only) which senses the banknotes in the container 40.

The container 40 has a front wall 40*a* which is located in front in the transport direction of the banknotes and is configured to be movable forward and backward in the transport direction. The position of the front wall 40*a* is adjusted according to the kind of the banknotes specified as those to be bundled. In other words, the dimension of the container 40 in the transport direction is adjusted based on the dimension of the banknotes as measured along their shorter edges. In particular, the front wall 40*a* is arranged such that the banknotes brought into the container 40 collide against the front wall 40*a* and fall as they are to the bottom of the container 40 so as to be stacked there in contact with the front wall 40*a*. The front wall 40*a* is also configured to open/close in the vertical direction. The front wall 40*a* opens when the stacked banknotes are transported by the second transport unit 8.

The container 40 has openings through the second side surface 114 of the housing 11. That is to say, the second side surface 114 is provided with the first outlets 46 through which the banknotes stacked in the bundling stackers 4 are removed out of the housing 11.

The door 43 is provided for each of the bundling stackers 4. The door 43 is configured to be rotatable around a predetermined rotation axis to change between an open state where the first outlet 46 is opened and a closed state where the first outlet 46 is closed. The door 43 is made of a material which allows for visual check of the inside of the bundling stacker from outside. For example, the door 43 may be made of a transparent or translucent material (e.g., glass or a resin). The door 43 is an exemplary open/close unit.

The door 43 is manually opened/closed. Note that the door 43 is provided with a lock mechanism 47 (shown in FIG. 3 only). The lock mechanism 47 is configured to be able to switch the door 43 between a restricted state where the door 43 is restricted to the closed state and a released state where the door 43 is openable and closable. Particularly, the lock mechanism 47 includes a pin 47*a* and a drive mechanism 47*b* including a solenoid and other suitable members for driving the pin 47*a*. The pin 47*a* and the drive mechanism 47*b* are provided on the housing 11, and an engaging member 47*c* which engages with the pin 47*a* is provided on the door 43. The lock mechanism 47 is controlled on a bundling stacker (4) basis by a control unit 120 to be described later.

A stopper 43*a* (not shown in FIG. 1) which the short edges of the banknotes come into contact with is provided on an inner surface of the door 43. The stopper 43*a* is made of a material which allows for visual check of the inside of the bundling stacker from outside. For example, the stopper 43*a* may be made of a transparent or translucent material (e.g., glass or a resin).

The stacking wheel 42 includes a plurality of flexible blades, and has the function of tapping the banknotes falling into the container 40 on their rear edges in the transport direction so as to help the banknotes fall. Even when the banknotes are brought into the container 40 successively, each of the banknotes is prevented from being inserted below the preceding banknote, and thus the banknotes can be sequentially stacked one by one on top of the previously stacked ones.

The aligner mechanism 44 is provided for the container 40 on the opposite side from the first outlet 46. The aligner mechanism 44 aligns the edges of the banknotes orthogonal to both of the transport direction and the stacking direction of the banknotes (hereinafter referred to as "the width direction"). In the present embodiment, the banknotes are transported along their shorter edges, and thus the width direction corresponds to the longer edges of the banknotes. That is to say, the aligner mechanism 44 aligns the shorter sides of the banknotes with each other. The aligner mechanism 44 includes an arm 44*a* provided at an end of the container 40 opposite from the first outlet 46 so as to be rotatable around the shaft extending in the stacking direction of the banknotes, and a stepping motor 44*b* which rotates the arm 44*a*. The aligner mechanism 44 presses, with the arm 44*a*, the banknotes stacked in the container 40 on one of their ends in the width direction (i.e., on one of their shorter sides) toward the door 43 in the width direction to bring the other end of the banknotes in the width direction (i.e., the other short side) into contact with the stopper 43*a*. Thus, the banknotes in the container 40 are aligned while being in contact with the stopper 43*a*.

Two or more banknote sensors 45 are provided for each of the bundling stackers 4. In the present embodiment, two banknote sensors 45 are provided in the container 40 at different positions in the transport direction of the banknotes. Each of the banknote sensors 45 is arranged to project light in the stacking direction of the banknotes in the container 40. That is to say, the banknote sensor 45 can sense the presence of the banknotes in the container 40 when the light is blocked. The provision of the two banknote sensors 45 at the different positions in the transport direction enables any one of the banknote sensors 45 to sense the presence of the banknotes even when the positions of the banknotes vary in the transport direction in the container 40. Note that two or more banknote sensors 45 may be provided at different positions in the direction orthogonal to both of the transport and thickness directions of the banknotes (the direction coming out of the paper of FIG. 2).

<Detailed Configuration for Non-Bundling Stacker 5>

Since the first and second non-bundling stackers 5A and 5B have the same configuration, they are not distinguished from each other in the following description, and will be hereinafter collectively referred to as "non-bundling stackers 5". When the non-bundling stackers 5 need to be distinguished from each other, the members of the first non-bundling stacker 5A will be identified hereinafter by the suffix "a" added to their reference numeral, and the members of the second non-bundling stacker 5B will be identified hereinafter by the suffix "b" added to their reference numeral.

The non-bundling stackers 5 pile and stack the banknotes. Each of the non-bundling stackers 5 includes a container 50 in which the banknotes are stacked, a stacking wheel 51 which brings the transported banknotes into the container 50, and a stacking sensor 52 which senses the presence of the banknotes.

The container 50 of each of the non-bundling stackers 5 has a tilted bottom. Thus, the banknotes brought into the container 50 are collected to the lower end of the bottom.

The stacking sensor 52 is provided at the lower end of the bottom of the container 50. The stacking sensor 52 is configured in the same manner as the banknote sensor 25, and senses the banknotes in the container 50 when the light is blocked. The stacking sensor 52 is arranged such that the light is blocked by the banknotes in the container 50.

The stacking wheel 51 includes a plurality of blades, and catches the transported banknotes between the blades to bring them into the container 50. The banknotes are released from the blades of the stacking wheel 51 near the bottom of the container 50, and are stacked in the container 50.

The container 50 has openings through the second side surface 114 of the housing 11. That is to say, the second side surface 114 is provided with second outlets 53 through which the banknotes stacked in the non-bundling stackers 5 are removed out of the housing 11. The second outlets 53 have no door, and are kept opened. The second outlets 53*a* and 53*b* of the first and second non-bundling stackers 5A and 5B are opened through the second side surface 114 and are arranged side by side in the horizontal direction.

Each of the non-bundling stackers 5 is provided with a pushing mechanism 54 which pushes the stacked banknotes toward the second outlet 53. The pushing mechanism 54 is provided at the horizontal depth of the container 50 (opposite from the second outlet 53), and is configured to push the banknotes from the horizontal depth to the front (toward the second outlet 53).

<Detailed Configuration for Reject Stacker 6>

The reject stacker 6 piles and stacks the banknotes. The reject stacker 6 includes a container 60 in which the banknotes are stacked, a stacking wheel 61 which brings the transported banknotes into the container 60, a stacking sensor 62 which senses the presence of the banknotes, and stoppers 64, 64 which prevent the banknotes in the container 60 from being ejected outside.

Specifically, the container 60 of the reject stacker 6 has an opening through the first and second side surfaces 113 and 114 of the housing 11. That is, a reject outlet 63 through which the banknotes stacked in the reject stacker 6 are removed out of the housing 11 is provided through the first and second side surfaces 113 and 114. The reject outlet 63 is opened through the first side surface 113 to be positioned above the inlet 24 and below the dispense port 101. Specifically, the reject outlet 63 is opened immediately below the step between the hopper unit 2 and the dispense unit 10. The reject outlet 63 has no door, and is kept opened.

The bottom of the container 60 is tilted such that the more distant from the first side surface 113, the lower the level of the bottom. Thus, the banknotes in the container 60 are stacked deep inside the first side surface 113. Thus, the banknotes are prevented from being ejected outside through the reject outlet 63 of the first side surface 113 when they are brought into the container 60.

The two stoppers 64, 64 are provided at one edge of the bottom of the container 60 closer to the first side surface 113. The stoppers 64 are supported to be rotatable around an axis extending parallel to the edge of the bottom closer to the first side surface 113, and are biased by bias springs (not shown) to stand up on the bottom of the container 60. These stoppers 64, 64 can also prevent the banknotes in the container 60 from being ejected outside through the reject outlet 63 of the first side surface 113. Note that in removing the banknotes stacked in the reject stacker 6 through the reject outlet 63, the stoppers 64, 64 need to be pressed down against the elastic force of the bias springs.

The stacking wheel 61 includes a plurality of flexible blades, and has the function of tapping the banknotes falling into the container 60 on their rear edges in the transport direction so as to let the banknotes fall. Even when the banknotes are brought into the container 60 successively, each of the banknotes is prevented from being inserted below the rear edge of the preceding banknote, and thus the banknotes can be sequentially stacked one by one on top of the previously stacked ones.

The stacking sensor 62 is configured in the same manner as the banknote sensor 25, and senses the banknotes in the container 60 when the light is blocked. The stacking sensor 62 is arranged such that the light is blocked by the banknotes in the container 60.

<System Configuration for Banknote Handling Apparatus>

Figure 4:
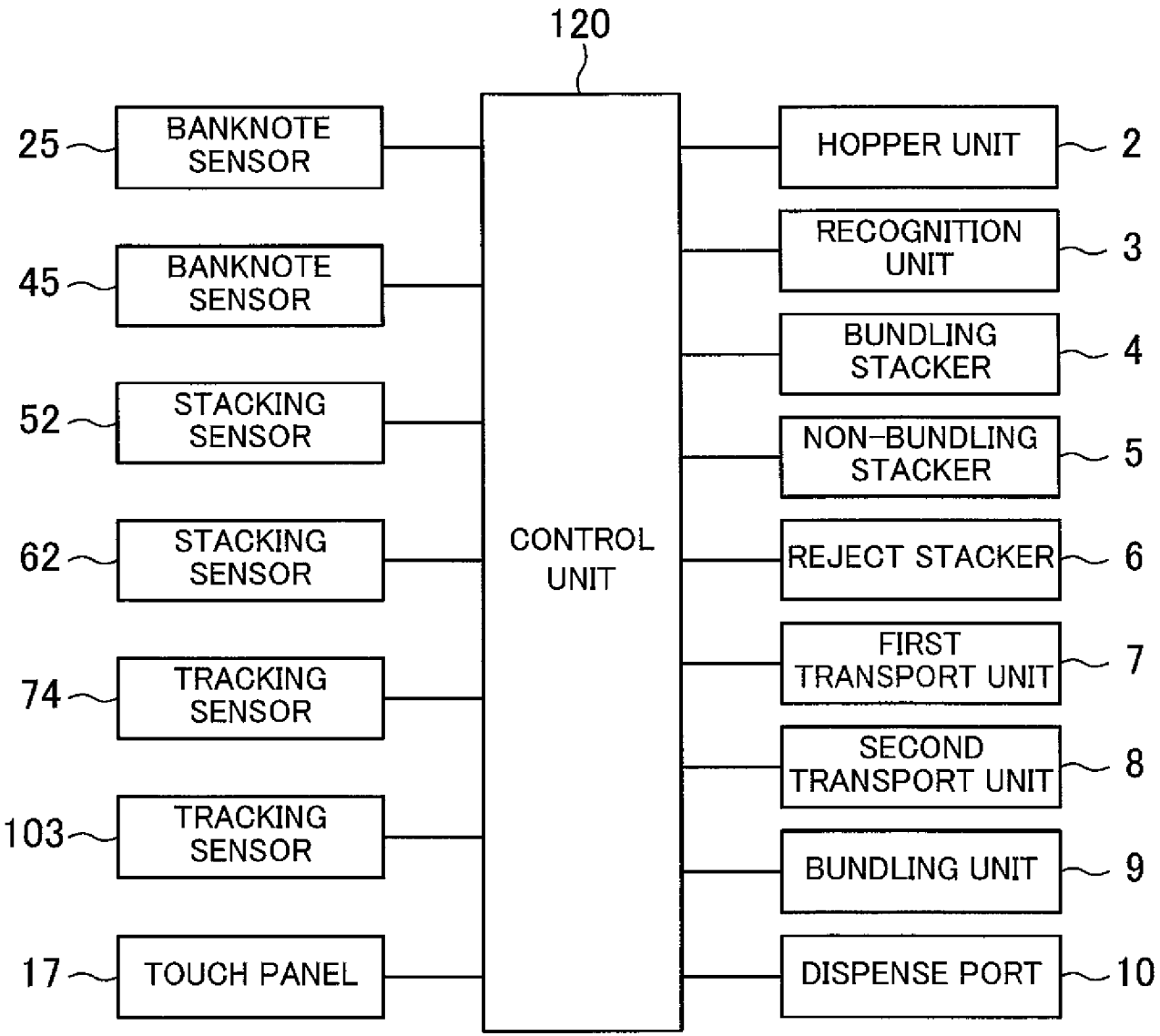
FIG. 4 is a block diagram illustrating a general configuration for the banknote handling apparatus.

FIG. 4 is a block diagram illustrating a general configuration for the banknote handling apparatus 100.

The banknote handling apparatus 100 includes a control unit 120 based on a well-known microcomputer, for example. The control unit 120 is connected to the above-described units, namely, the hopper unit 2, the recognition unit 3, the bundling stackers 4, the non-bundling stackers 5, the reject stacker 6, the first and second transport units 7 and 8, the bundling unit 9, the dispense unit 10, and the touch panel 17 so as to transmit and receive signals to/from these units. The control unit 120 is also connected to the banknote sensors 25 and 45, the stacking sensors 52 and 62, and the tracking sensors 74 and 103 to receive detection signals from these sensors. The control unit 120 generates a control signal based on the signal supplied from the touch panel 17, the detection signals from the sensors and other suitable signals, and outputs the generated control signal to the hopper unit 2 and other units. The hopper unit 2 and other units operate in accordance with the control signal. Taking the bundling stacker 4 as an example, the control unit 120 controls the front wall 40*a* of the container 40, the stage 41, the stacking wheel 42, the lock mechanism 47 of the door 43, and the stepping motor 44*b* of the aligner mechanism 44.

<Working Mechanism of Banknote Handling Apparatus>

It will be described how to perform a deposit process using this banknote handling apparatus 100. In the deposit process, loose banknotes are sorted and stacked in the predetermined stackers, and predetermined ones of them are bundled. In the following description, a single kind banknote bundling process will be described, in which a predetermined number of banknotes of a prescribed kind to be bundled are stacked alternately in the first and second bundling stackers 4A, 4B, and the predetermined number of banknotes stacked are bundled sequentially by the bundling unit 9.

The banknote handling apparatus 100 is placed on a teller counter to be positioned on the front left side of the operator (on the front right side of a customer) when the operator faces the customer over the teller counter. At this time, the banknote handling apparatus 100 is arranged such that the first side surface 113 of the housing 11 faces the customer. In this state, the second side surface 114 of the housing 11 faces the operator. However, since the banknote handling apparatus 100 is located slightly on the front left side of the operator, the customer can also see the second side surface 114.

First, the operator receives loose banknotes to be deposited from the customer, and places the banknotes on the hopper unit 2. At this time, even if the loose banknotes include banknotes of multiple different kinds, all the banknotes are just placed on the hopper unit 2 without sorting them. The operator adjusts the guides 22 according to the dimension of the banknotes. Then, the operator operates the touch panel 17 to start the intake of the banknotes. The banknote handling apparatus 100 may automatically start the intake of the banknotes when the banknote sensor 25 senses the banknotes placed on the hopper unit 2.

The banknotes placed on the hopper unit 2 are brought into the housing 11 one by one through the inlet 24 as the intake rollers 23 are activated. The banknotes thus taken in are transported by the first transport unit 7, and pass through the recognition unit 3. The recognition unit 3 senses the kind of the banknotes passed, and informs the control unit 120 of the kind of the banknotes.

The control unit 120 designates the banknotes' destination according to the kind of the banknotes. In particular, if the banknotes are fit banknotes of a predetermined denomination to be bundled, the control unit 120 designates the bundling stacker 4 (any one of the bundling stackers 4A and 4B) as their destination. If the banknotes are unfit banknotes of the predetermined denomination to be bundled, the control unit 120 designates the first non-bundling stacker 5A as their destination. If the banknotes are of any denomination other than the predetermined denomination, the control unit 120 designates the second non-bundling stacker 5B as their destination. If the banknotes are rejected banknotes, the control unit 120 designates the reject stacker 6 as their destination.

The control unit 120 controls the first transport unit 7 such that the banknotes are transported to the stacker designated as their destination. In particular, the control unit 120 controls the sorting mechanism 73 corresponding to the diverged path 72 leading to the destination stacker such that the banknotes are guided from the main transport path 71 to the diverged path 72. The control unit 120 switches the sorting mechanism 73 when the tracking sensor 74 located just before the diverged path 72 senses the banknotes. Further, the control unit 120 controls the stacking wheel 42, 51, or 61 of the destination stacker to bring the banknotes into that stacker.

The banknotes to be transported to the bundling stacker 4 are transported to one of the two bundling stackers 4. When the number of banknotes stacked in one of the bundling stackers 4 reaches a predetermined bundling number (e.g., 100), the remaining banknotes are then transported to the other bundling stacker 4. In this example, the banknotes are supposed to be transported to the first bundling stacker 4A first.

When the banknotes are transported one after another to the first bundling stacker 4A, the stacking wheel 42 rotates to stack the banknotes one by one. The banknotes brought into the container 40 come into contact with the front wall 40*a*, and thus the longer sides thereof are aligned.

When the number of banknotes stacked in the first bundling stacker 4A reaches the bundling number, the control unit 120 activates the aligner mechanism 44 to align the shorter sides of the banknotes with each other. Optionally, the control unit 120 may activate the aligner mechanism 44 to align the shorter sides of the banknotes with each other every time the banknotes are brought into the container 40. Then, the control unit 120 controls the second transport unit 8 to grip the banknotes in the first bundling stacker 4A with the hands 81 to transport them to the stage 85. Thereafter, the control unit 120 controls the bundling unit 9 so that the banknotes on the stage 85 are bundled with the bundling band.

When the number of banknotes stacked in the first bundling stacker 4A reaches the bundling number, the remaining banknotes are stacked in the second bundling stacker 4B. Then, when the number of banknotes stacked in the second bundling stacker 4B reaches the bundling number, the remaining banknotes are stacked again in the first bundling stacker 4A. By this time, the banknotes in the first bundling stacker 4A have already been bundled, and thus the first bundling stacker 4A is now empty. Thus, the provision of the two bundling stackers 4 allows for performing the bundling process while stacking the banknotes continuously.

Subsequently, the control unit 120 allows the pushing mechanism 86 to push the bundled banknotes on the stage 85 to dispense them to the stage 102 through the dispense port 101. When the bundled banknotes are dispensed to the stage 102, the stage 102 sinks under the weight of the bundled banknotes to the level at which there are no bundled banknotes horizontally outside of the dispense port 101. Thus, the stage 102 prepares for the next dispensation of the bundled banknotes.

The unfit banknotes of the predetermined denomination are transported to the first non-bundling stacker 5A. When the banknotes are transported to the first non-bundling stacker 5A, the stacking wheel 51 a rotates to stack the transported banknotes in the container 50*a*. Thus, the unfit banknotes of the predetermined denomination are stacked in the first non-bundling stacker 5A. Likewise, the banknotes of every denomination but the predetermined one are transported to, and stacked in, the second non-bundling stacker 5B. The rejected banknotes are also transported to, and stacked in, the reject stacker 6.

This series of processing steps will be performed over and over again until there are no banknotes placed on the hopper unit 2. The banknote sensor 25 determines whether banknotes are still present on the hopper unit 2 or not.

When the handling of the banknotes placed on the hopper unit 2 is finished, the rejected banknotes are taken in and recognized again. Specifically, the operator extracts the rejected banknotes from the reject stacker 6, and places them on the hopper unit 2 to take them into the apparatus again. The rejected banknotes are those which were not recognized as normal banknotes for any reason, and thus another attempt is made to insert and recognize them. Banknotes still recognized as rejected banknotes, if any, are restacked in the reject stacker 6. Then, the operator returns those restacked banknotes to the customer.

Note that the banknotes stacked in the first and second non-bundling stackers 5A, 5B are not taken in again.

Thus, when the handling of the banknotes placed on the hopper unit 2 and the re-handling of the rejected banknotes are finished, the single kind banknote bundling process is finished, i.e., the counting and sorting of the banknotes passed as those to be deposited by the customer are finished. The touch panel 17 displays the counted amount of the banknotes. The operator asks for a customer's approval of the amount, or checks whether the displayed amount corresponds with the amount described on a deposit slip by the customer, and, if the answer is YES, the operator operates the touch panel 17 to confirm the deposit amount. When the confirmation is done, a teller terminal (not shown) is informed of the confirmed deposit amount, thereby finishing the deposit process.

After the deposit process is finished, the operator removes the bundled banknotes stacked in the dispense unit 10, the banknotes stacked in the bundling stacker 4, and the banknotes stacked in the non-bundling stackers 5, and stores them in a predetermined storage place.

Through the above-described process, the loose banknotes including banknotes of multiple different kinds are sorted into fit banknotes of a predetermined denomination, unfit banknotes of the predetermined denomination, banknotes of any denominations other than the predetermined denomination, and rejected banknotes. The fit banknotes of the predetermined denomination are bundled into multiple bundles on a bundling number basis.

<Setting of Stackers>

In the foregoing description, the first and second bundling stackers 4A, 4B stack fit banknotes of a predetermined denomination, the first non-bundling stacker 5A stacks unfit banknotes of the predetermined denomination, and the second non-bundling stacker 5B stacks banknotes of every denomination but the predetermined one.

However, the banknotes to be stacked in the first and second bundling stackers 4A, 4B and the first and second non-bundling stackers 5A, 5B of the banknote handling apparatus 100 may be determined as appropriate. FIG. 5 shows various combinations of banknotes to be stacked in those stackers. Referring to FIG. 5, the stackers for which no kinds of banknotes are specified may stack any designated kinds of banknotes. The banknotes stacked in the first bundling stacker 4A may be replaced with those stacked in the second bundling stacker 4B, and vice versa. Likewise, the banknotes stacked in the first non-bundling stacker 5A may be replaced with those stacked in the second non-bundling stacker 5B. The combinations shown in FIG. 5 are provided merely as examples, and other combinations are also applicable.

Pattern 1 shows the combination of the stackers and the banknotes adopted in the above-described continuous bundling process.

In Pattern 2, the first and second bundling stackers 4A, 4B stack banknotes of a predetermined denomination, and the second non-bundling stacker 5B stacks banknotes of every denomination but the predetermined one. Note that other conditions may be or may not be added as long as the banknotes to be stacked in the first and second bundling stackers 4A, 4B are of the predetermined denomination. For example, the first and second bundling stackers 4A, 4B may stack all banknotes of the predetermined denomination, regardless of their fitness level, their orientation, and their oldness or newness. Alternatively, the first and second bundling stackers 4A, 4B may stack banknotes of the predetermined denomination that have been sorted according to at least one of conditions such as their fitness level, their orientation, and their oldness or newness. Still alternatively, the banknotes of the predetermined denomination may be sorted into two groups according to their fitness level, their orientation, and their oldness or newness such that the first and second bundling stackers 4A, 4B stack the banknotes of two different properties. The banknotes to be stacked in the first non-bundling stacker 5A may be determined as appropriate. Pattern 1 is an implementation of Pattern 2.

In Pattern 3, the first and second bundling stackers 4A, 4B stack fit banknotes of the predetermined denomination, and the first non-bundling stacker 5A stacks unfit banknotes of the predetermined denomination. Note that other conditions may be or may not be added as long as banknotes of the predetermined denomination are stacked in the first and second bundling stackers 4A, 4B. The first and second bundling stackers 4A and 4B may stack banknotes of the same property or different properties. Pattern 1 is an implementation of Pattern 3.

Pattern 3-A is an implementation of Pattern 3. In Pattern 3-A, the first and second bundling stackers 4A, 4B stack the fit banknotes of the predetermined denomination which are further sorted according to still another property. The first bundling stacker 4A stacks the fit banknotes of the predetermined denomination which have their face turned upward, and the second bundling stacker 4B stacks the fit banknotes of the predetermined denomination which have their back turned upward.

Pattern 3-B is an implementation of Pattern 3. In Pattern 3-B, the first and second bundling stackers 4A, 4B stack fit banknotes of the predetermined denomination which are further sorted according to their fitness level. Specifically, the fit banknotes are sorted into those of Fitness Level 1 (ATM) and those of Fitness level 2 (TELLER). The fit banknotes of Fitness Level 1 are those which are usable in ATMs, and the fit banknotes of Fitness Level 2 are those which are not usable in the ATMs. In other words, if the fitness level has three grades, the banknotes are sorted into fit banknotes of Fitness Level 1, fit banknotes of Fitness Level 2, and unfit banknotes. In this case, Fitness Level 1 corresponds to the first level, Fitness Level 2 corresponds to the second level, and the unfit banknotes correspond to the third level. If the fitness level has two grades, the banknotes are sorted into fit banknotes (FIT) and unfit banknotes (UNFIT). In that case, the fit banknotes correspond to the first level, and the unfit banknotes correspond to the second level. In Pattern 3-B, the first bundling stacker 4A stacks fit banknotes of the predetermined denomination and of Fitness Level 1, and the second bundling stacker 4B stacks fit banknotes of the predetermined denomination and of Fitness Level 2.

Pattern 3-C is an implementation of Pattern 3. Pattern 3-C is different from Pattern 3-B in that the banknotes to be stacked in the first and second bundling stackers 4A and 4B and the first non-bundling stacker 5A are further sorted according to yet another property. Specifically, the banknotes stacked in the first and second bundling stackers 4A and 4B and the first non-bundling stacker 5A share the common properties that they are of the predetermined denomination and of one of new and old versions. It may be determined as appropriate whether the banknotes to be stacked there are new ones or old ones. In Pattern 4, the first and second bundling stackers 4A, 4B stack banknotes of the predetermined denomination that have one of their face and their back turned upward, the first non-bundling stacker 5A stacks banknotes of the predetermined denomination that have the other of their face and their back turned upward, and the second non-bundling stacker 5B stacks banknotes of every denomination but the predetermined one. It may be determined as appropriate which of the first and second bundling stackers 4A, 4B and the first non-bundling stacker 5A is going to stack banknotes that have their face turned upward, and which of these stackers is going to stack the banknotes that have their back turned upward.

Pattern 4-A is an implementation of Pattern 4. In Pattern 4-A, banknotes of the predetermined denomination that have one of their face and their back turned upward are further sorted according to yet another property such that they are stacked in the first and second bundling stackers 4A, 4B. Specifically, the first bundling stacker 4A stacks banknotes of the predetermined denomination that have one of their face and their back turned upward which have a print orientation (i.e., an orientation of letters and/or portraits printed on each banknote) corresponding with the transport direction (indicated as "portrait-up" in FIG. 5: this state will be hereinafter referred to as "a print facing forward"). The second bundling stacker 4B stacks banknotes of the predetermined denomination that have one of their face and their back turned upward which have a print facing opposite to the transport direction (indicated as "portrait-down" in FIG. 5: this state will be hereinafter referred to as "a print facing backward").

In Pattern 5, the first and second bundling stackers 4A, 4B stack banknotes of the predetermined denomination that have one of their face and their back turned upward which have one of the print facing forward or the one facing backward. The first non-bundling stacker 5A stacks banknotes of the predetermined denomination that have one of their face and their back turned upward which have the other of the print facing forward and the one facing backward. The second non-bundling stacker 5B stacks banknotes of the predetermined denomination that have the other of their face and their back turned upward. It may be determined as appropriate which of the first and second bundling stackers 4A and 4B and the first and second non-bundling stackers 5A and 5B is going to stack banknotes that have their face turned upward, and which of these stackers is going to stack banknotes that have their back turned upward. Further, it may also be determined as appropriate which of the first and second bundling stackers 4A, 4B and the first non-bundling stacker 5A is going to stack banknotes, of which the print faces forward, and which of these stackers is going to stack the banknotes, of which the print faces backward.

Pattern 6 is different from Pattern 5 in the property of the banknotes stacked in the second non-bundling stacker 5B. In Pattern 6, the first and second bundling stackers 4A, 4B stack banknotes of the predetermined denomination that have one of their face and their back turned upward which have one of the print facing forward and the one facing backward. The first non-bundling stacker 5A stacks banknotes of the predetermined denomination that have one of their face and their back turned upward which have the other of the print facing forward and the one facing backward. The second non-bundling stacker 5B stacks the banknotes of every denomination but the predetermined one.

Pattern 7 is different from Pattern 4 in the property according to which the banknotes of the predetermined denomination are sorted to be stacked in the first and second bundling stackers 4A, 4B and the first non-bundling stacker 5A. In Pattern 7, the first and second bundling stackers 4A, 4B stack banknotes of the predetermined denomination and of one of new and old versions, the first non-bundling stacker 5A stacks banknotes of the predetermined denomination and of the other of new and old versions, and the second non-bundling stacker 5B stacks banknotes of every denomination but the predetermined one. It may be determined as appropriate which of the first and second bundling stackers 4A, 4B and the first non-bundling stacker 5A is going to stack new banknotes, and which of these stackers is going to stack old banknotes.

Pattern 7-A is an implementation of Pattern 7. In Pattern 7-A, banknotes of the predetermined denomination and of one of new and old versions are further sorted according to yet another property to be stacked the first and second bundling stackers 4A, 4B. Specifically, the first bundling stacker 4A stacks fit banknotes of the predetermined denomination and of one of new and old versions, and the second bundling stacker 4B stacks unfit banknotes of the predetermined denomination and one of the new and old versions.

Pattern 7-B is an implementation of Pattern 7. In Pattern 7-B, banknotes of the predetermined denomination and of one of new and old versions are sorted according to a different property from in Pattern 7-A to be stacked in the first and second bundling stackers 4A, 4B. Specifically, the first bundling stacker 4A stacks banknotes of the predetermined denomination and of one of new and old versions which have their face turned upward. The second bundling stacker 4B stacks banknotes of the predetermined denomination and of one of the new and old versions which have their back turned upward.

In Pattern 8, the first bundling stacker 4A stacks banknotes of a first denomination, and the second bundling stacker 4B stacks banknotes of a second denomination.

In this manner, banknotes of various properties may be designated as banknotes to be stacked in the first and second bundling stackers 4A, 4B and the first and second non-bundling stackers 5A, 5B.

<Display of Touch panel>

Figure 6:
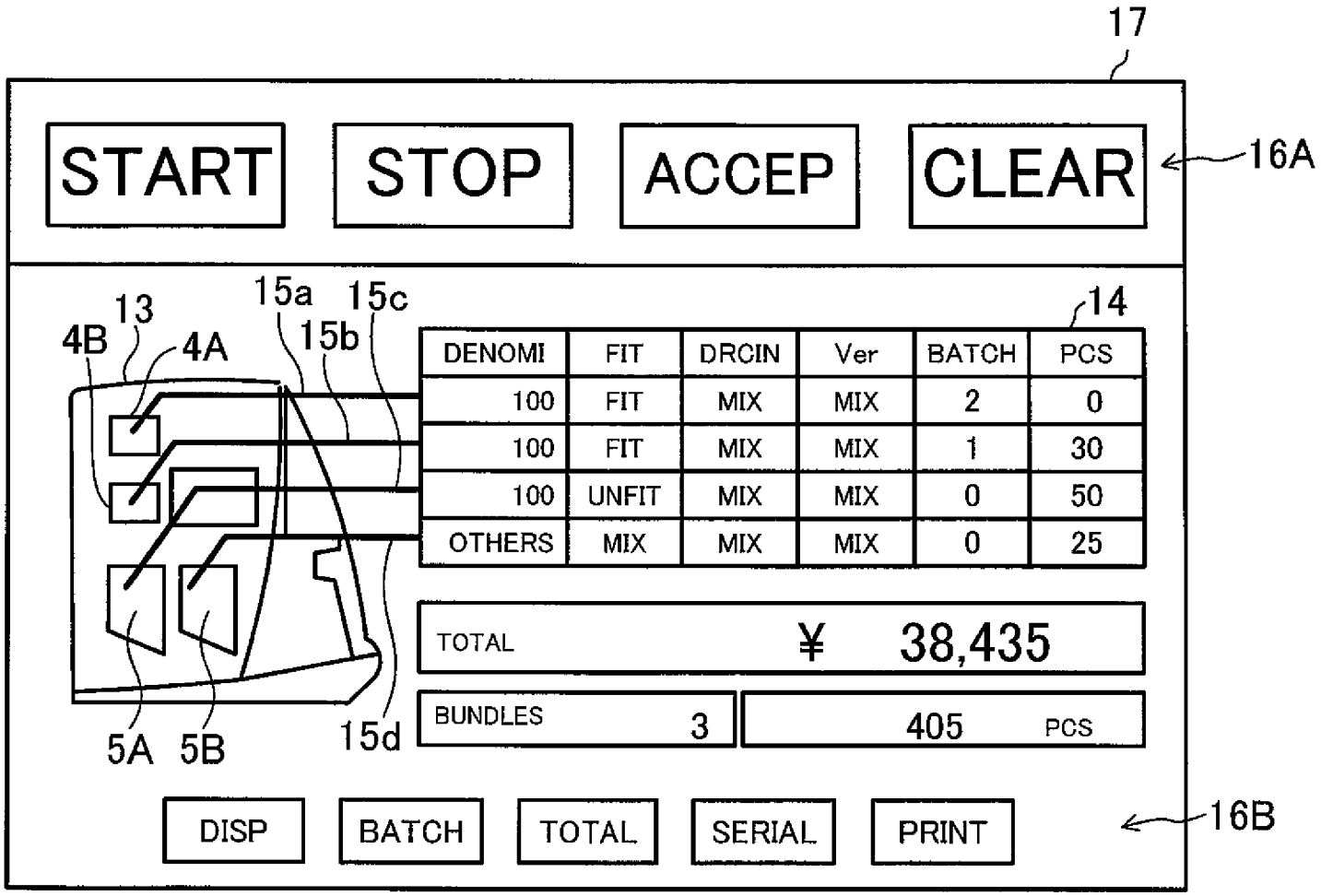
FIG. 6 shows a display screen of a touch panel.

FIG. 6 shows the display screen of a touch panel 17.

The touch panel 17 displays a schematic diagram 13 of the banknote handling apparatus 100, a table 14 showing information about the stacked banknotes, lines 15 representing correspondences between the stackers shown in the schematic diagram 13 and the banknotes indicated in the table 14, and an operation unit 16.

The schematic diagram 13 represents some components of the apparatus including the first and second bundling stackers 4A and 4B, and the first and second non-bundling stackers 5A and 5B.

The table 14 shows, as information about the stacked banknotes, the properties of the banknotes and the amount of the stacked banknotes. The properties of the banknotes include their denomination, their fitness level, their orientation, and their newness or oldness. The amount of the stacked banknotes includes the number of bundles, and the number of banknotes. The information shown in the table 14 is just a non-limiting example.

Specifically, the denomination is shown in the column "DENOMI." The denomination may be represented by 100, 50, 20, 10, 5, 2, or 1 Chinese Yuen, OTHERS indicating other denominations, or MIX, which indicates that the banknotes are not distinguished according to denomination.

The fitness level is shown in the column "FIT." The fitness level may be represented by FIT indicating fit banknotes, ATM indicating Fitness Level 1, TELLER indicating Fitness Level 2, and UNFIT indicating unfit banknotes.

The orientation of the banknotes is shown in the column "DRCIN." The orientation of the banknotes may be represented by FACE indicating that the banknote has its face turned upward, BACK indicating that the banknote has its back turned upward, A indicating that the banknote has its face turned upward with its print facing forward, B indicating that the banknote has its face turned upward with its print facing backward, C indicating that the banknote has its back turned upward with its print facing backward, D indicating that the banknote has its back turned upward with its print facing forward, or MIX indicating that no distinction is made. FACE includes A and B. BACK includes C and D.

Whether the banknote is old or new is shown in the column "Ver." Whether the banknote is old or new may be represented by NEW indicating that the banknote is new, OLD indicating that the banknote is old, and MIX indicating that no distinction is made.

The number of bundles is shown in the column "BATCH." This is the number of bundles of banknotes which have been stacked to the predetermined number and then bundled. In the continuous bundling process described above, only the banknotes stacked in the first and second bundling stackers 4A and 4B are bundled. Thus, only the number of bundles of banknotes stacked and bundled in the first and second bundling stackers 4A and 4B is counted. Note that the banknote handling apparatus 100 may perform a divisional process in which the banknotes are sorted according to the set conditions, and the sorted banknotes are stacked on a predetermined number basis in the associated stackers. In the divisional process, when the number of banknotes stacked in the stacker reaches the predetermined number, the banknotes are stored as they are without being bundled, and are removed by the operator. When the banknotes are removed, the banknotes start to be stacked again in the associated stacker. In this divisional process, the banknotes are handled on a bundle basis not only in the first and second bundling stackers 4A and 4B, but also in the first and second non-bundling stackers 5A and 5B. Thus, the number of bundles stacked in all the stackers is counted in the divisional process.

The number of banknotes is shown in the column "PCS." In the continuous bundling process, the banknotes are stacked in only one of the first and second bundling stackers 4A, 4B. Thus, the number of the banknotes stacked in the other bundling stacker is The lines 15 connect the stackers shown in the schematic diagram 13 to the banknotes in the table 14. Specifically, a first line 15*a* connects the first bundling stacker 4A in the schematic diagram 13 to the second row of the table 14. A second line 15*b* connects the second bundling stacker 4B in the schematic diagram 13 to the third row of the table 14. A third line 15*c* connects the second non-bundling stacker 5A in the schematic diagram 13 to the fourth row of the table 14. A fourth line 15*d* connects the first non-bundling stacker 5B in the schematic diagram 13 to the fifth row of the table 14.

The operation unit 16 includes an upper operation unit 16A provided in an upper portion of the display unit 17, and a lower operation unit 16B provided in a lower portion of the display unit 17. The upper operation unit 16A is provided mainly to allow the user to perform operations related to the bundling process of the banknote handling apparatus 100, and includes a plurality of buttons associated with the operations. The lower operation unit 16B is provided to allow the user to perform operations related to the display unit 17 and settings of the banknote handling apparatus 100, and includes a plurality of buttons associated with the operations.

The display screen also displays the total amount of banknotes, the total number of bundles, and the total number of banknotes.

On the display screen of the display unit 17, the lines 15 connect the stackers shown in the schematic diagram 13 of the banknote handling apparatus 100 to the properties of the banknotes shown in the table 14. Thus, one can easily understand visually the properties of the banknotes stacked in the stackers of the banknote handling apparatus 100. For example, it can be seen that the first bundling stacker 4A is supposed to stack fit banknotes of 100 Chinese Yuen which are not distinguished according to their orientation or their newness/oldness, that the first bundling stacker 4A stacks no banknotes at present, and that the number of bundles already handled is 2. It can also be seen that the second bundling stacker 4B is supposed to stack fit banknotes of 100 Chinese Yuen which are not distinguished according to their orientation or their newness/oldness, that the second bundling stacker 4B stacks 30 banknotes at present, and that the number of bundles already handled is 1. It can also be seen that the first non-bundling stacker 5A is supposed to stack unfit banknotes of 100 Chinese Yuen which are not distinguished according to their orientation or their newness/oldness, and that the first non-bundling stacker 5A stacks 50 banknotes at present. Further, it can also be seen that the second non-bundling stacker 5B is supposed to stack banknotes of every denomination but 100 Chinese Yuen which are not distinguished according to their fitness level, their orientation, or their newness/oldness, and that the second non-bundling stacker 5B stacks 25 banknotes at present.

<Advantages>

The banknote handling apparatus 100 includes the inlet 24 through which the banknotes are taken in one by one, the first and second transport units 7 and 8 configured to transport the banknotes taken in through the inlet 24, the recognition unit 3 configured to recognize the banknotes taken in through the inlet 24, the bundling stackers 4 configured to stack the banknotes recognized, by the recognition unit 3, as banknotes to be bundled, the non-bundling stackers 5 configured to stack the banknotes recognized, by the recognition unit, 3 as banknotes not to be bundled, a bundling unit 9 configured to bundle the banknotes stacked in the bundling stackers 4, and a dispense port 101 through which a bundle of banknotes bundled by the bundling unit 9 is dispensed. The bundling stackers 4 are comprised of only two bundling stackers, and the non-bundling stackers 5 are comprised of only two non-bundling stackers.

According to this configuration, only two bundling stackers 4 and only two non-bundling stackers 5 are provided. Thus, the number of the bundling stackers 4 and the non-bundling stackers 5 is limited, which allows for making the banknote handling apparatus 100 compact. The two bundling stackers 4 allow for performing a continuous bundling process, in which the banknotes to be bundled are first stacked in one of the two bundling stackers 4, and start to be bundled when the number of banknotes stacked there reaches a predetermined number, while the banknotes to be bundled continue being stacked in the other bundling stacker 4, and start to be bundled when the number of banknotes stacked in the other bundling stacker 4 reaches the predetermined number. Alternatively, the two bundling stackers 4 allow for sorting the banknotes to be bundled into two groups such that the banknotes of different properties are stacked and bundled separately. Further, the two non-bundling stackers 5 allow for sorting the banknotes not to be bundled into two groups such that the banknotes of different properties are stacked separately. Thus, the banknotes are handled efficiently.

The banknote handling apparatus 100 further includes a touch panel 17 which displays the locations of the bundling stackers 4, 4 and the non-bundling stackers 5, 5, and information about the banknotes stacked in the bundling stackers 4, 4 and the non-bundling stackers 5, 5.

According to this configuration, one can easily understand what kind of banknotes are stacked in which part of the banknote handling apparatus 100.

The bundling stackers 4, 4 and the non-bundling stackers 5, 5 are provided with outlets 46, 53 through which the stacked banknotes are removed outside. First outlets 46 of the bundling stackers 4 are provided with doors 43, each of which is openable and closable on a bundling stacker (4) basis. Second outlets 53 of the non-bundling stackers 5 are provided with no doors, and are kept opened.

According to this configuration, the banknotes stacked in the bundling stackers 4, 4, and the non-bundling stackers 5, 5 are removable through the outlets 46, 53. The doors 43 provided for the first outlets 46 of the bundling stackers 4 allow for preventing unwanted popping of the banknotes from the first outlets 46. The second outlets 53 of the non-bundling stackers 5 have no open/close units, and thus the banknotes stacked in the non-bundling stackers are removable easily.

The banknote handling apparatus 100 further includes a reject stacker 6 configured to stack the banknotes recognized, by the recognition unit 3, as banknotes to be rejected.

According to this configuration, the reject stacker 6 is provided in addition to the two bundling stackers 4, 4 and the two non-bundling stackers 5, 5. Thus, the rejected banknotes are easily sorted and stacked separately.

To allow the bundling stackers 4, 4 and non-bundling stackers 5, 5 to handle the banknotes efficiently, the banknotes may be stacked in those stackers in the following combinations:

For example, both of the two bundling stackers 4, 4 may stack the banknotes recognized, by the recognition unit 3, as banknotes of a predetermined denomination. One of the two non-bundling stackers 5, 5 may stack the banknotes recognized, by the recognition unit 3, as banknotes of every denomination but the predetermined one.

Alternatively, the recognition unit 3 may sort the banknotes into the two kinds, namely, fit banknotes and unfit banknotes. Both of the two bundling stackers 4, 4 may stack banknotes recognized, by the recognition unit 3, as fit banknotes of a predetermined denomination. One of the two non-bundling stackers 5, 5 may stack banknotes recognized, by the recognition unit 3, as unfit banknotes of the predetermined denomination.

On the premise that this configuration is adopted, one of the two bundling stackers 4, 4 may stack banknotes that have been recognized, by the recognition unit 3, as fit banknotes of the predetermined denomination which have their face turned upward, and the other of the two bundling stackers 4, 4 may stack banknotes that have been recognized, by the recognition unit 3, as fit banknotes of the predetermined denomination which have their back turned upward.

Still alternatively, the recognition unit 3 may sort the banknotes according to fitness level into fit banknotes of Fitness Level 1, fit banknotes of Fitness Level 2, and unfit banknotes. One of the two bundling stackers 4, 4 may stack banknotes recognized, by the recognition unit 3, as fit banknotes of a predetermined denomination and of Fitness Level 1. The other of the two bundling stackers 4, 4 may stack banknotes recognized, by the recognition unit 3, as fit banknotes of the predetermined denomination and of Fitness Level 2. One of the two non-bundling stackers 5, 5 may stack banknotes recognized, by the recognition unit 3, as unfit banknotes of the predetermined denomination.

Yet alternatively, both of the two bundling stackers 4, 4 may stack banknotes that have been recognized, by the recognition unit 3, as banknotes of the predetermined denomination which have one of their face and back turned upward. One of the two non-bundling stackers 5, 5 may stack banknotes that have been recognized, by the recognition unit 3, as banknotes of the predetermined denomination that have the other of their face and their back turned upward. The other of the two non-bundling stackers 5, 5 may stack the banknotes recognized, by the recognition unit 3, as banknotes of every denomination but the predetermined one.

On the premise that this configuration is adopted, one of the two bundling stackers 4, 4 may stack banknotes that have been recognized, by the recognition unit 3, as banknotes of the predetermined denomination that have one of their face and their back turned upward which have a print facing forward. The other of the two bundling stackers 4, 4 may stack banknotes that have been recognized, by the recognition unit 3, as banknotes of the predetermined denomination that have turned one of their face and back upward which have a print facing backward.

Still alternatively, both of the two bundling stackers 4, 4 may stack banknotes that have been recognized, by the recognition unit 3, as banknotes of the predetermined denomination that have one of their face and their back turned upward which have a print faces forward. One of the two non-bundling stackers 5, 5 may stack banknotes that have been recognized, by the recognition unit 3, as banknotes of the predetermined denomination that have turned one of their face and back upward which have a print faces backward. The other of the two non-bundling stackers 5, 5 may stack banknotes that have been recognized, by the recognition unit 3, as banknotes of the predetermined denomination that have the other of their face and their back turned upward or as banknotes of every denomination but the predetermined one.

Yet alternatively, both of the two bundling stackers 4, 4 may stack banknotes recognized, by the recognition unit 3, as banknotes of the predetermined denomination and of one of new and old versions. One of the two non-bundling stackers 5, 5 may stack banknotes recognized, by the recognition unit 3, as banknotes of the predetermined denomination and of the other of the new and old versions. The other of the two non-bundling stackers 5, 5 may stack the banknotes recognized, by the recognition unit 3, as banknotes of every denomination but the predetermined one.

On the premise that this configuration is adopted, one of the two bundling stackers 4, 4 may stack banknotes that have been recognized, by the recognition unit 3, as banknotes of the predetermined denomination and of one of the new and old versions which have been recognized to be fit banknotes. The other of the two bundling stackers 4, 4 may stack banknotes that have been recognized, by the recognition unit 3, as banknotes of the predetermined denomination and of one of the new and old versions which have been recognized to be unfit banknotes.

Yet alternatively, one of the two bundling stackers 4, 4 may stack banknotes that have been recognized, by the recognition unit 3, as banknotes of the predetermined denomination and of one of the new and old versions which have their face turned upward. The other of the two bundling stackers 4, 4 may stack banknotes that have been recognized, by the recognition unit 3, as banknotes of the predetermined denomination and of one of the new and old versions which have their back turned upward.

Still alternatively, one of the two bundling stackers 4, 4 may stack banknotes that have been recognized, by the recognition unit 3, as banknotes of the predetermined denomination and of one of the new and old versions which have been recognized to be fit banknotes of Fitness Level 1. The other of the two bundling stackers 4, 4 may stack banknotes that have been recognized, by the recognition unit 3, as banknotes of the predetermined denomination and of one of the new and old versions which have been recognized to be fit banknotes of Fitness Level 2. One of the two non-bundling stackers 5, 5 may stack banknotes that have been recognized, by the recognition unit 3, as banknotes of the predetermined denomination and of one of the new and old versions which have been recognized to be unfit banknotes.

Yet alternatively, one of the bundling stackers 4, 4 may stack banknotes recognized, by the recognition unit 3, as banknotes of a first predetermined denomination, and the other of the bundling stackers 4, 4 may stack banknotes recognized, by the recognition unit 3, as banknotes of a second predetermined denomination.

(Second Embodiment)

Figure 7:
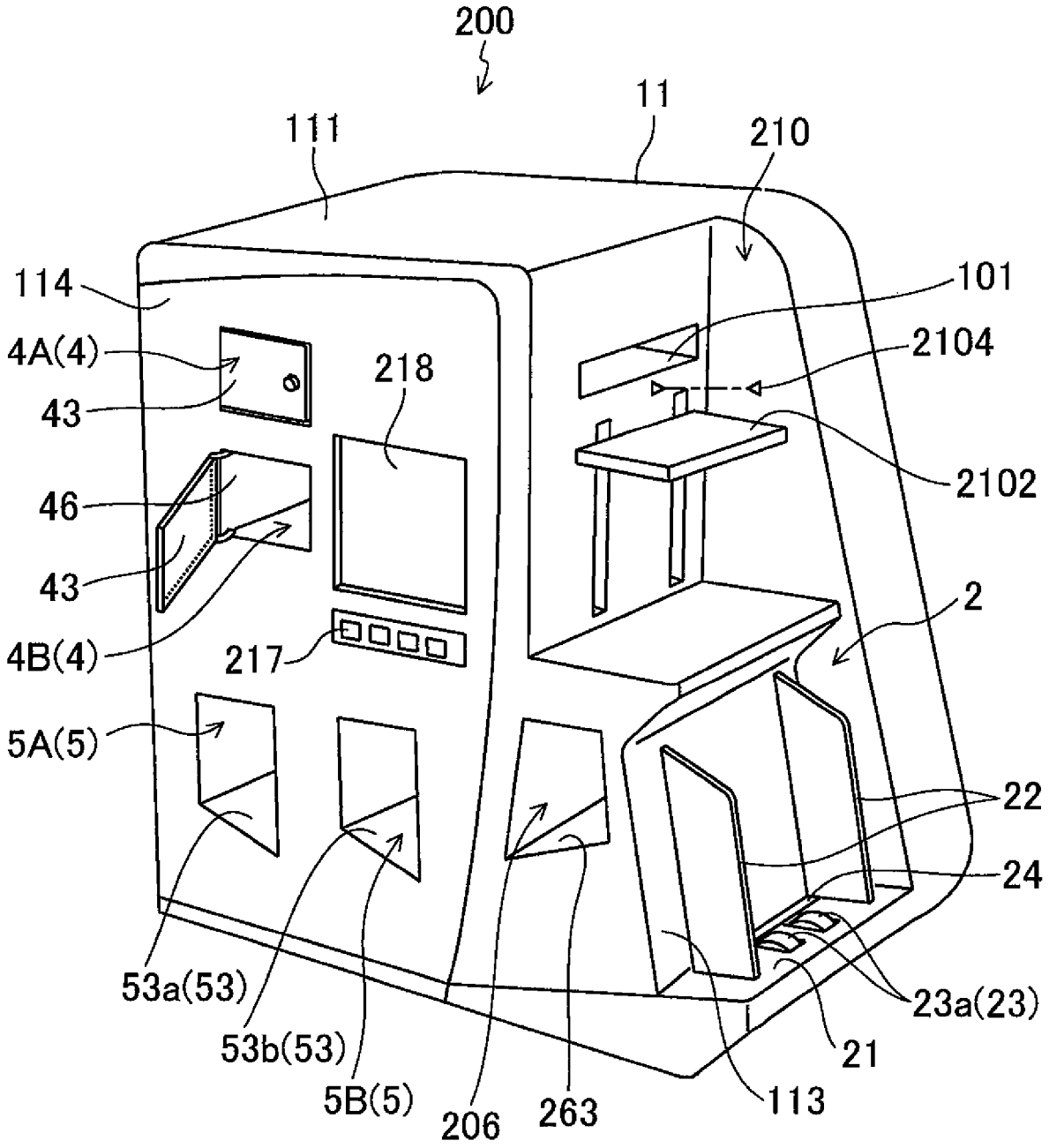
FIG. 7 is a view illustrating the appearance of a banknote handling apparatus according to a second embodiment.
Figure 8:
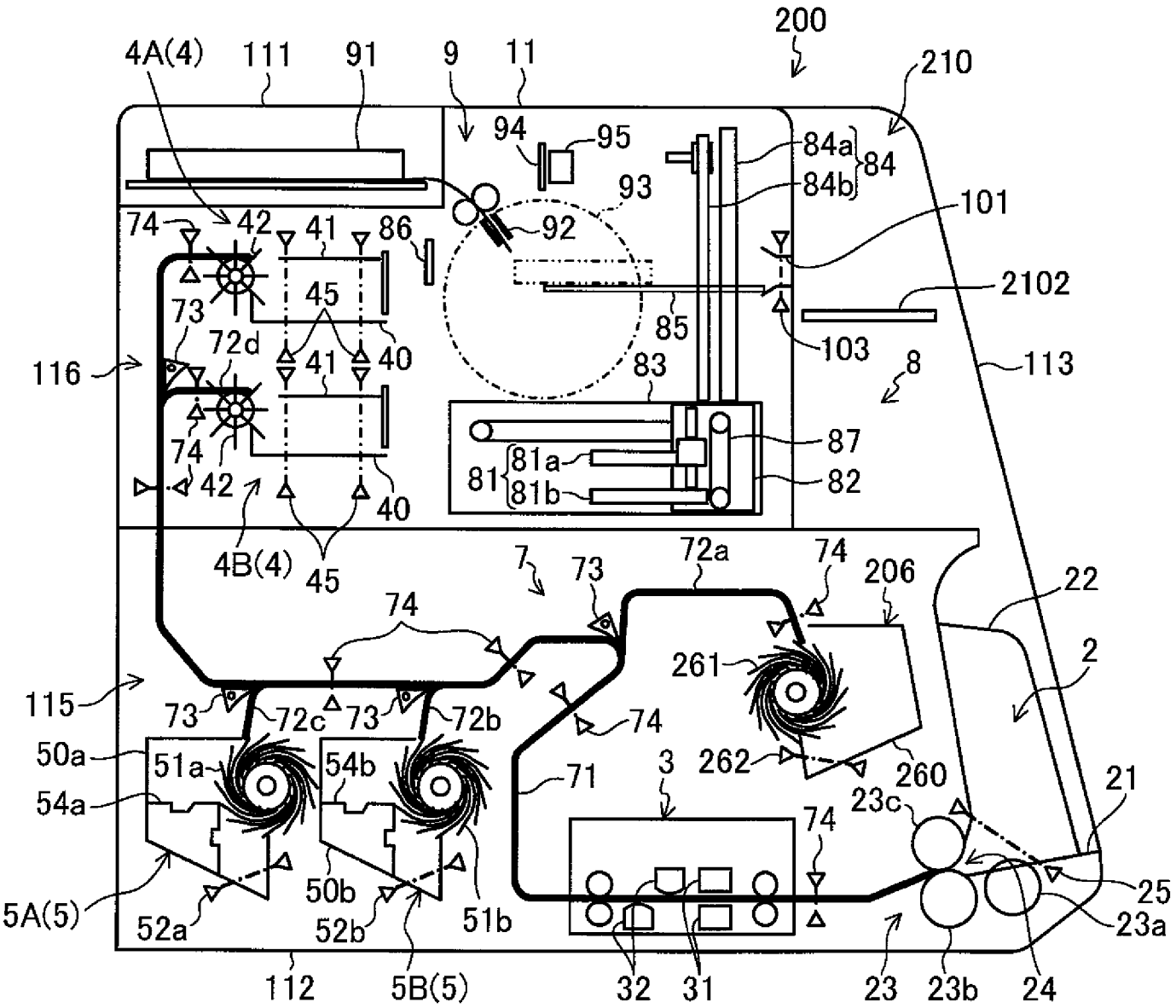
FIG. 8 illustrates a general configuration for the banknote handling apparatus.

Next, a banknote handling apparatus 200 according to a second embodiment will be described. FIG. 7 shows the appearance of the banknote handling apparatus 200, and FIG. 8 shows a general configuration for the banknote handling apparatus 200.

The banknote handling apparatus 200 is different from the banknote handling apparatus 100 in the respective configurations of a reject stacker 206, a dispense unit 210, a display unit 217, and an input unit 218. Thus, some components of the banknote handling apparatus 200 which are the same or similar to their counterparts of the first embodiment will be identified by the same reference characters, and they will not be described in detail. Note that some components of the banknote handling apparatuses 100 and 200 having the same or similar functions will be identified by the reference characters having the same numbers in the tens place and the ones place.

Specifically, the reject stacker 206 includes a container 260 in which the banknotes are stacked, a stacking wheel 261 which brings the transported banknotes into the container 260, and a stacking sensor 262 which senses the presence of the banknotes.

The container 260 has a tilted bottom. Thus, the banknotes brought into the container 260 are collected toward the lower end of the bottom. The stacking sensor 262 is provided at the lower end of the bottom of the container 260. The stacking sensor 262 is configured in the same manner as the banknote sensor 25, and senses the banknotes in the container 260 when the light is blocked. The stacking sensor 262 is arranged such that the light is blocked by the banknotes in the container 260. The stacking wheel 261 is configured in the same manner as the stacking wheel 51, includes a plurality of blades, and catches the transported banknotes between the blades to bring them into the container 260. The banknotes are released from the blades of the stacking wheel 261 near the bottom of the container 260, and are stacked in the container 260.

The container 260 does not have any opening through the first side surface 113 of the housing 11, but does have an opening through the second side surface 114. Specifically, the second side surface 114 is provided with a reject outlet 263 through which the banknotes stacked in the reject stacker 206 are removed out of the housing 11. The reject outlet 263 has no door, and is kept opened.

The dispense unit 210 includes a dispense port 101 through which the bundled banknotes are dispensed, a stage 2102 on which the bundled banknotes dispensed from the dispense port 101 are placed, a tracking sensor 103 which senses the passage of the bundled banknotes through the dispense port 101, and a banknote sensor 2104 which senses the bundled banknotes on the stage 2102.

The stage 2102 is configured to be movable in the vertical direction, and is driven to move in the vertical direction by a drive mechanism (not shown).

The banknote sensor 2104 is provided immediately below the dispense port 101 to sense whether the banknotes on the stage 2102 are located immediately below the dispense port 101 or not. The banknote sensor 2104 is configured in the same manner as the banknote sensor 25. The stage 2102 is controlled such that the bundled banknotes that have already been placed thereon are located at such a level where the banknotes are not sensed by the banknote sensor 2104 again. Thus, no bundled banknotes are present at the same level as the dispense port 101, and the bundled banknotes dispensed from the dispense port 101 are stacked one after another on the bundled banknotes that have already been placed on the stage 2102.

The banknote handling apparatus 200 includes, in place of the touch panel 17, operating buttons 217 through which information is entered into the banknote handling apparatus 200, and a liquid crystal display panel 218 displaying information about the banknote handling apparatus 200, both of which are provided on the second side surface 114 of the housing 11. Specifically, the operating buttons 217 and the liquid crystal display panel 218 are provided above the second outlet 53*b* of the second non-bundling stacker 5B and beside the second bundling stacker 4B. The operating buttons 217 include various types of buttons. The operating buttons 217 and the liquid crystal display panel 218 is a human interface for the operator who operates the banknote handling apparatus 200. The liquid crystal display panel 218 is an exemplary display unit.

Also in this banknote handling apparatus 200, first outlets 46 of the bundling stackers 4 are provided with doors 43 which are openable/closable on the bundling stacker (4)

basis. A lock mechanism 47 provided for each of the bundling stackers 4 is controlled in the same manner as in the first embodiment.

(Other Embodiments)

Embodiments have just been described as examples of the technique disclosed in the present application. However, the present disclosure is not limited to those exemplary embodiments, but is also applicable to other embodiments which are altered or substituted, to which other features are added, or from which some features are omitted, as needed. Optionally, the components described in those embodiments may be combined to create a new embodiment. The components illustrated on the accompanying drawings and described in the detailed description include not only essential components that need to be used to overcome the problem, but also other unessential components that do not have to be used to overcome the problem. Therefore, such unessential components should not be taken for essential ones, simply because such unessential components are illustrated in the drawings or mentioned in the detailed description.

The above-described embodiments may be modified in the following manner.

The reject stacker 6 provided in the above-described embodiments may be omitted.

In the first embodiment, the inlet 24, the dispense port 101 and the reject outlet 63 are provided through the first side surface 113, and the first and second outlets 46 and 53 and the touch panel 17 are provided for the second side surface 114. However, this arrangement is merely an example. In the second embodiment, the inlet 24 and the dispense port 101 are provided through the first side surface 113, and the first and second outlets 46 and 53, the reject outlet 263, the operating buttons 217, and the liquid crystal display panel 218 are provided for the second side surface 114. However, this arrangement is merely an example, too.

For example, the inlet 24 may be provided through the first side surface 113, and the dispense port 101 may be provided through the second side surface 114. Conversely, the dispense port 101 may be provided through the first side surface 113, and the inlet 24 may be provided through the second side surface 114. In addition to such a configuration, the first and second outlets 46 and 53 may be provided through the first side surface 113. Alternatively, the first and second outlets 46 and 53 may be provided through the second side surface 114. Still alternatively, the first outlet 46 may be provided through the first side surface 113 and the second outlet 53 may be provided through the second side surface 114. Yet alternatively, the second outlet 53 may be provided through the first side surface 113 and the first outlet 46 may be provided through the second side surface 114.

If the inlet 24 is provided through the second side surface 114, the hopper unit 2 is provided to have an opening through the second side surface 114 just like the non-bundling stacker 5. If the dispense port 101 is provided through the second side surface 114, the dispense unit 10 is provided to have an opening through the second side surface 114 just like the non-bundling stacker 5.

In the foregoing description, the inlet 24, the dispense port 101, and the first and second outlets 46 and 53 are all supposed to be provided through the first and second side surfaces 113 and 114 only. However, they may be provided through any other surfaces. Specifically, the inlet 24 and other ports may be provided through the top surface 111, the side surface opposed to the first side surface 113, or the side surface facing the second side surface 114 of the housing 11.

The door 43 is provided with the lock mechanism 47, but the lock mechanism 47 may be omitted. In this case, the door 43 may be opened/closed freely. Thus, if the door 43 is opened when it should be closed, the control unit 120 stops the process being performed. If the door 43 is opened when it may be opened, the control unit 120 continues the process being performed.

The door 43 is configured to rotate simply around a predetermined rotation axis, but is not limited to such a configuration. For example, the door 43 may be a sliding door. Alternatively, the door 43 may be provided with a spring which biases the door 43 in a direction in which the door 43 opens such that the door is released by pushing the door 43 inward, i.e., toward the bundling stacker 4, when the lock mechanism 47 is unlocked, thereby opening the door 43 by the biasing force of the spring. Still alternatively, the door 43 may be provided with a holding mechanism which keeps the door 43 open. This makes the removal of the banknotes easy when the door 43 is kept open.

The door 43 is made of a transparent or translucent material, but this is only a non-limiting example. The door 43 may also be configured as a door with a lattice, slits or holes, or a meshed door such that the inside of the bundling stacker 4 is visible from outside. Conversely, the door 43 may even be configured such that the inside of the bundling stacker 4 is invisible from outside.

The stopper 43*a* is configured as a member provided separately from the door 43, and is fixed to the door 43, but does not have to have such a configuration. Alternatively, the stopper 43*a* and the door 43 may be integrated with each other. For example, the inner surface of the door 43 may be configured as the stopper 43*a*. Still alternatively, a protrusion may be provided on the inner surface of the door 43 so as to function as the stopper 43*a*. The stopper 43*a* is made of a transparent or translucent material, but is not limited thereto. The stopper 43*a* may also be configured as a stopper with a lattice, slits or holes, or a meshed stopper such that the inside of the bundling stacker 4 is visible from outside. Conversely, the stopper 43*a* may even be configured such that the inside of the bundling stacker 4 is invisible from outside.

An open/close unit such as a door may be provided for the second outlet 53 of the non-bundling stacker 5 and/or the reject outlet 63 of the reject stacker 6.

The banknote handling apparatuses 100, 200 are supposed to handle loose banknotes including banknotes of multiple different denominations, but the banknotes to be handled by the apparatuses are not always the banknotes of multiple different denominations. The banknote handling apparatuses 100, 200 may be configured to handle banknotes of a single predetermined denomination as well.

As can be seen from the foregoing description, the present disclosure is useful for a banknote handling apparatus which takes in loose banknotes, bundles the banknotes, and dispenses the bundled banknotes.

What is claimed is:

1. A banknote handling apparatus comprising:

a housing having a first side surface;

an inlet through which banknotes are taken in into the housing one by one;

a transport unit configured to transport each of the banknotes taken in into the housing through the inlet;

a recognition unit configured to recognize each of the banknotes being transported by the transport unit;

a bundling stacker including a first bundling stacker and a second bundling stacker each configured to stack first banknotes recognized, by the recognition unit, as banknotes to be bundled, the first banknotes being fit banknotes of a first denomination;

a non-bundling stacker including a first non-bundling stacker and a second non-bundling stacker, the first non-bundling stacker being configured to stack second banknotes recognized, by the recognition unit, as banknotes not to be bundled, the second banknotes being unfit banknotes of the first denomination, the second non-bundling stacker being configured to stack third banknotes recognized, by the recognition unit, as banknotes not to be bundled, the third banknotes being banknotes of a second denomination;

a bundling unit configured to bundle a predetermined number of the first banknotes stacked in the bundling stacker with a bundling band; and a dispense port configured to dispense the first banknotes bundled with the bundling band by the bundling unit, wherein the bundling stacker has a first opening formed through the first side surface and having a door for opening or closing the first opening, and the non-bundling stacker has a second opening formed through the first side surface, the second opening not having a door for opening or closing the second opening.

2. The banknote handling apparatus of claim 1, wherein the recognition unit recognizes the each banknote according to fitness level as a first-level banknote or a second-level banknote, both of the first and second bundling stackers stack the first banknote recognized, by the recognition unit, as the first-level banknote of the first denomination, the first non-bundling stacker stacks the second banknote recognized, by the recognition unit, as the second-level banknote of the first denomination, and the second non-bundling stacker stacks the third banknote recognized, by the recognition unit, as a banknote of the second denomination but the first denomination.

3. The banknote handling apparatus of claim 1, wherein both of the first and second bundling stackers stack the each banknote recognized, by the recognition unit, as a banknote of the first denomination which has one of a face and a back of the banknote turned upward, and the first non-bundling stacker stacks the each banknote recognized, by the recognition unit, as a banknote of the first denomination which has the other of the face and the back of the banknote turned upward.

4. The banknote handling apparatus of claim 1, further comprising a reject stacking unit configured to stack the banknotes recognized, by the recognition unit, as banknotes to be rejected.

5. The banknote handling apparatus of claim 1, further comprising:

a controller configured to control the transport unit, wherein the controller controls the transport unit such that when the banknotes recognized by the recognition unit are the first banknotes, the first banknotes are transported to the first bundling stacker by the transport unit, and the first bundling stacker stacks the predetermined bundling number of first banknotes, the remaining first banknotes that have not been transported to the first bundling stacker are transported to the second bundling stacker by the transport unit.

6. The banknote handling apparatus of claim 5, wherein the controller controls the transport unit such that when the second bundling stacker stacks the predetermined bundling number of first banknotes, the remaining first banknotes that have not been transported to the second bundling stacker are transported to the first bundling stacker by the transport unit.

7. The banknote handling apparatus of claim 5, further comprising:

a stage on which the first banknotes stacked in the bundling stacker are placed, wherein after the predetermined bundling number of first banknotes are stacked in the bundling stacker the transport unit transports the predetermined bundling number of first banknotes to the stage.

8. The banknote handling apparatus of claim 6, wherein the controller controls the bundling unit such that the predetermined bundling number of the first banknotes placed on the stage are bundled with the bundling band.

9. The banknote handling apparatus of claim 1, wherein the controller controls the transport unit such that when the banknotes recognized by the recognition unit are the second banknotes, the transport unit transports the second banknotes to the first non-bundling stacker, and controls the transport unit such that when the banknotes recognized by the recognition unit are the third banknotes, the transport unit transports the third banknotes to the second non-bundling stacker.

10. The banknote handling apparatus of claim 1, wherein the second and third banknotes stacked in the non-bundling stacker are removable out of the housing through the second opening.

11. The banknote handling apparatus of claim 1, wherein the non-bundling stacker includes a pushing mechanism configured to push the second and third banknotes stacked in the non-bundling stacker toward the second opening.

12. The banknote handling apparatus of claim 1, wherein the door is provided with a locking mechanism configured to switch the door between a restricted state where the door is closed and a released state where the door is openable and closable.

* * * * *